US010973327B2

(12) United States Patent
Chelaidite

(10) Patent No.: US 10,973,327 B2
(45) Date of Patent: Apr. 13, 2021

(54) POWER RECLINING FURNITURE AND RECLINING MECHANISM THEREOF

(71) Applicant: Galus Chelaidite, South Lyon, MI (US)

(72) Inventor: Galus Chelaidite, South Lyon, MI (US)

( * ) Notice: Subject to any disclaimer, the term of this patent is extended or adjusted under 35 U.S.C. 154(b) by 157 days.

(21) Appl. No.: 16/456,104

(22) Filed: Jun. 28, 2019

(65) Prior Publication Data

US 2020/0015589 A1 Jan. 16, 2020

Related U.S. Application Data

(60) Provisional application No. 62/697,559, filed on Jul. 13, 2018.

(51) Int. Cl.
*A47C 1/032* (2006.01)

(52) U.S. Cl.
CPC ..... *A47C 1/03294* (2013.01)

(58) Field of Classification Search
None
See application file for complete search history.

(56) References Cited

U.S. PATENT DOCUMENTS 507,270 A * 10/1893 Hirschfeld ..... A47C 7/5064 297/423.22
1,815,877 A * 7/1931 Thum ..... A47C 17/17 5/47
4,072,342 A 2/1978 Johnson et al.
4,108,491 A 8/1978 Rogers, Jr.
4,402,096 A 9/1983 Atimichuk
5,147,108 A 9/1992 LaPointe
5,682,629 A 11/1997 Bortoluzzi
5,772,278 A 6/1998 Kowalski
5,779,310 A 7/1998 Suskey et al.
6,588,837 B1 7/2003 Schultz et al.
7,083,235 B2 8/2006 Grimm et al.
7,261,367 B2 8/2007 Duncan et al.
7,547,072 B1 6/2009 Delmestri
7,806,478 B1 * 10/2010 Cvek ..... A47C 1/03294 297/300.1
7,850,232 B2 12/2010 Casteel
9,386,857 B2 7/2016 Lawson et al.
9,403,597 B2 8/2016 Ferry et al.
9,433,295 B2 9/2016 Crum
10,334,951 B2 * 7/2019 Robertson ..... A47C 1/03294
10,869,555 B2 * 12/2020 Jones ..... A47C 31/008
2007/0252422 A1 11/2007 Beaver et al.
2011/0304193 A1 12/2011 Murphy et al.
2015/0076891 A1 3/2015 LaPointe et al.
2015/0150376 A1 * 6/2015 Hogue ..... A47C 3/34 297/183.5

FOREIGN PATENT DOCUMENTS

GB 209263 A * 1/1924 ..... A47C 17/2073

* cited by examiner

*Primary Examiner* — David E Allred
(74) *Attorney, Agent, or Firm* — Young Basile Hanlon & MacFarlane, P.C.

(57) ABSTRACT

A recliner, comprising: (a) a stationary base frame; (b) a cushion frame slidably engaged to the base frame; and (c) a backrest frame pivotally engaged to the cushion frame via a pair of opposing recliner mechanisms mounted to the base frame, wherein, as the cushion frame extends in an extension direction, the cushion frame engages the pair of opposing recliner mechanisms so that the backrest frame pivots in a reclining direction simultaneously with the extension of the cushion frame.

14 Claims, 9 Drawing Sheets

POWER RECLINING FURNITURE AND RECLINING MECHANISM THEREOF

FIELD

The present teachings generally relate to power reclining furniture, and more particularly, power reclining furniture adjusted via one or more reclining mechanisms.

BACKGROUND

Reclining furniture is common in a variety of applications to provide users with a multi-functional seating unit that may extend from an upright position, where a user can generally sit in a more upright seated position, to a reclined position, where a user can extend in a substantially more prone position relative to the upright position. Reclining furniture may include a variety of configurations, such as chairs, loveseats, sofas, futons, couches, beds, gliders, rockers, or a combination thereof. Frequently, the reclining furniture may include one or more recliner mechanisms that movably join any combination of sections of the reclining furniture such as a backrest, a seat, and a leg extension section. In this manner, the recliner mechanisms may allow for, based on user interaction, movement of the backrest, the base, the leg extension, or a combination thereof.

The recliner mechanisms may be a pair of matching mechanisms positioned on opposing sides of a frame of the reclining furniture. Often a user may engage a lever or latch that results in the recliner mechanisms being manually engaged to extend or retract the backrest, the base, the leg extension, or a combination thereof. However, frequently as the backrest moves to a reclined position, the backrest is pivoted relative to the seat of the reclining furniture. As a result, typically the reclining furniture cannot be positioned near a wall to ensure that the wall is not damaged from the reclining movement.

In an attempt to alleviate some of the problems arising from use of the conventional recliner mechanisms, some recliner mechanisms may allow for reclining of the backrest free of the backrest pivoting rearward relative to a base position of the furniture (often referred to as a "wall-proximity" recliner mechanism). To prevent the backrest from pivoting rearward relative to the base, the recliner mechanisms may move the seat of the chair forward relative to the base (i.e., in a direction opposite of the backrest reclining direction). However, such recliner mechanisms may require a large footprint for the furniture to allow for the forward movement relative to the base. Additionally, the "wall-proximity" recliner mechanisms may only allow for a partial reclining of the backrest relative to the seat so that the backrest is unable to reach a position substantially flush with the seat. Furthermore, the "wall-proximity" recliner mechanisms may frequently be restricted to movement where the backrest and the seat must move simultaneously (e.g., as the backrest reclines the seat simultaneously moves forward).

Examples of recliner mechanisms and reclining furniture are disclosed in U.S. Pat. Nos. 4,072,342; 4,108,491; 4,402,096; 5,147,108; 5,682,629, 5,772,278; 5,779,310; 6,588,837; 7,083,235; 7,261,367; 7,547,072; 7,850,232; 9,386,857; 9,403,597; and 9,433,295; and U.S. Patent Publication Nos. 2007/0252422; 2011/0304193; and 2015/0076891, all of which are incorporated by reference herein for all purposes. It would be attractive to have a recliner mechanism that is configured to recline a backrest relative to a seat of a seating unit within close proximity to a wall or object. What is needed is a recliner mechanism that may recline a backrest relative to the seat and simultaneously or sequentially extend the backrest away from a wall or object. It would be attractive to have a recliner mechanism that may recline a backrest of a seating unit without movement of a seat of the seating unit. What is needed is a recliner mechanism that independently moves the backrest relative to the seat, vice versa, or both. It would be attractive to have a recliner mechanism that allows for a user to move from a seated position to a lying position. What is needed is a recliner mechanism that may recline the backrest to a substantially flush position with the seat of the seating unit. It would be attractive to have a recliner mechanism that allows for a user to automatically recline a backrest relative to a seat of the seating unit anywhere between an upright position and a reclined position. What is needed is a motorized recliner mechanism that may be driven by one or more spindles to support a position of the backrest in an upright position, a reclined position, one or more intermediate positions, or a combination thereof.

SUMMARY

The present teachings meet one or more of the present needs by providing a recliner, comprising: (a) a stationary base frame; (b) a cushion frame slidably engaged to the base frame; and (c) a backrest frame pivotally engaged to the cushion frame via a pair of opposing recliner mechanisms mounted to the base frame, wherein, as the cushion frame extends in an extension direction, the cushion frame engages the pair of opposing recliner mechanisms so that the backrest frame pivots in a reclining direction simultaneously with the extension of the cushion frame.

The present teachings meet one or more of the present needs by providing a recliner mechanism, comprising: (a) a guide plate having one or more slots; (b) a recliner arm pivotally engaged to the guide plate about a primary pivot; (c) a backrest arm pivotally engaged to the recliner arm about a backrest arm pivot; and (d) a backrest lock arm pivotally engaged to the backrest arm about a backrest lock arm pivot, wherein, as the backrest lock arm extends in an extension direction substantially away from the primary pivot, the backrest arm pivots about the backrest arm pivot and extends in the extension direction, thereby pivoting the recliner arm about the primary pivot.

The present teachings meet one or more of the present needs by providing a method, comprising the steps of: (a) wirelessly activating a reclining movement of a recliner via an electronic device in communication with a controller of the recliner; (b) activating an electromechanical unit mounted to a base frame of the recliner to drive a spindle connected to a cushion frame of the recliner, thereby driving the cushion frame in an extension direction substantially away from the electromechanical unit; (c) receiving an arm of opposing recliner mechanisms in respective opposing hook plates protruding from the cushion frame during extension of the cushion frame, thereby extending each arm in the extension direction; and (d) reclining a backrest of the recliner pivotally engaged to the cushion frame via the opposing recliner mechanisms.

The present teachings provide: a recliner mechanism that is configured to recline a backrest relative to a seat of a seating unit within close proximity to a wall or object; a recliner mechanism that may recline a backrest relative to the seat and simultaneously or sequentially extend the backrest away from a wall or object; a recliner mechanism that may recline a backrest of a seating unit without movement of a seat of the seating unit; a recliner mechanism that independently moves the backrest relative to the seat, vice versa, or both; a recliner mechanism that allows for a user to move from a seated position to a lying position; a recliner mechanism that may recline the backrest to a substantially flush position with the seat of the seating unit; a recliner mechanism that allows for a user to automatically recline a backrest relative to a seat of the seating unit anywhere between an upright position and a reclined position; a motorized recliner mechanism that may be driven by one or more spindles to support a position of the backrest in an upright position, a reclined position, one or more intermediate positions, or a combination thereof; or a combination thereof.

DETAILED DESCRIPTION

Figure 1:
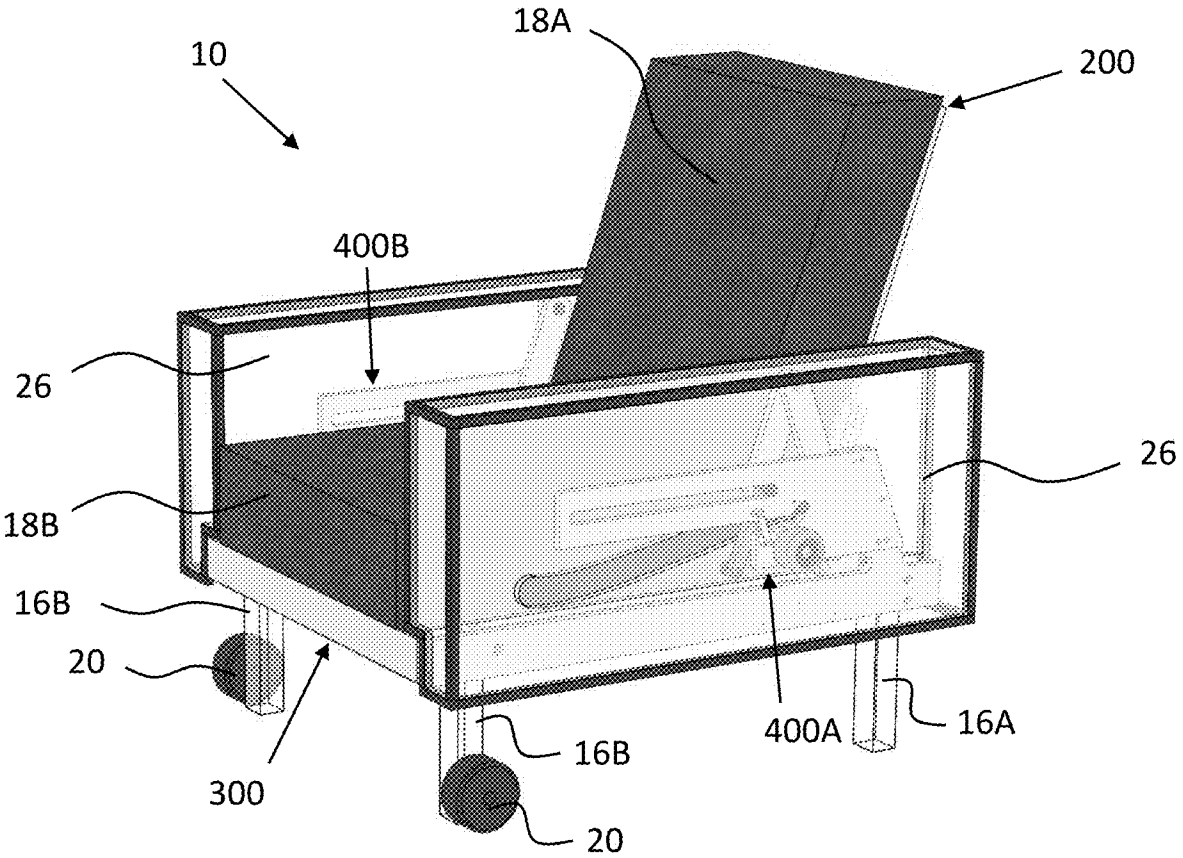
FIG. 1 illustrates a perspective view of a recliner in a fully retracted and upright position.

The explanations and illustrations presented herein are intended to acquaint others skilled in the art with the teachings, its principles, and its practical application. Those skilled in the art may adapt and apply the teachings in its numerous forms, as may be best suited to the requirements of a particular use. Accordingly, the specific embodiments of the present teachings as set forth are not intended as being exhaustive or limiting of the teachings. The scope of the teachings should, therefore, be determined not with reference to the description herein, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The teachings herein generally relate to a recliner. The recliner may refer to any seating unit having one or more portions that move relative to each other. The recliner may be any piece of furniture having one or more portions that pivot, extend, retract, or a combination thereof relative to each other. The recliner may be a chair, sofa, loveseat, futon, mattress, bed, sectional couch, or a combination thereof. The recliner may be a seating unit configured for indoor use, outdoor use (e.g., patio furniture), or both. The recliner may include one or more movable sections. For example, the recliner may include a base, a backrest, a seat, a footrest, or a combination thereof. The one or more movable sections may include one or more frames that form a recliner frame that support one or more cushions of the recliner. The recliner may include one or more structurally rigid members, one or more compressible or flexible components, or both. The recliner may be any size and shape based on a desired application. The recliner may consist of one or more materials, such as one or more metals, one or more fabrics, one or more polymers, one or more fibrous materials, or a combination thereof. For example, the recliner may include an aluminum frame supporting one or more foam cushions housed within a fabric cover.

The cushions may function to support one or more users of the recliner. The cushions may be compressible to decrease pressure on one or more users of the recliner. The cushions may include one or more foam or fibrous materials housed within a casing. The cushions may be any cushions configured for use with furniture or a seating unit. The cushions may be a solid piece, such as a rubber or polymer. The cushions may include one or more attachment points to attach to one or more frames of the recliner. The cushions may include one or more mechanical fasteners to secure the cushions to one or more frames. For example, the cushions may include one or more clips that are received by one or more holes on one or more frames. The cushions may be a plurality of cushions secured to a plurality of frames. For example, the recliner may include a backrest cushion secured to a backrest frame, a seat cushion secured to a cushion frame, or both. The cushions may be flexible. The cushions may secure to one or more side rails of a frame, one or more crossmembers of a frame, or both.

The one or more side rails may function to form a peripheral frame of the recliner. The one or more side rails may be structurally rigid to support a weight of one or more components of the recliner, one or more users of the recliner, or both. The one or more side rails may be solid or may have a hollow tubular structure. For example, the one or more side rails may be a hollow square tubing. The one or more side rails may secure to one or more crossmembers to form a desired frame shape. The shape may be any desired shape based on a given application, such as square, rectangular, rhombus, trapezoidal, circular, oval, triangular, or a combination thereof. The one or more side rails may be any length, diameter, or both. For example, the one or more side rails may have a length greater than a length of one or more crossmembers extending between the one or more side rails to form a substantially rectangular shape. Alternatively, the one or more side rails may have a length substantially similar to one or more crossmembers to form a substantially square shape. The one or more side rails may include one or more fasteners, one or more holes, or both to secure to one or more additional components of the recliner. The one or more fasteners may be a screw, bolt, nail, rivet, anchor, hook, loop, latch, or a combination thereof. The one or more rails may be free of any fasteners or holes (e.g., the one or more side rails may be welded, adhered, or both to one or more crossmembers to create a frame). The one or more side rails may include one or more attachment points to connect to and/or receive a portion of one or more crossmembers. For example, the one or more side rails may include a receiving hole to receive a protruding peg of a crossmember (e.g., the side rail may have a key-hole slot to receive a button of the crossmember), or vice versa. The one or more side rails may include one or more bearings to receive one or more spindles, shafts, or both of one or more additional frames. The one or more bearings may be a linear ball bearing, a recirculating ball bearing, a roller bearing, other bearing, or a combination thereof. The one or more side rails may include one or more support members or one or more joints to increase structural integrity of the one or more side rails. The one or more support members may include hems, joints, gussets, junctions, unions, or a combination thereof. A pair of side rails may secure one or more crossmembers spanning between the pair of side members.

The crossmembers may function to span across a length or width between a plurality of side rails. The crossmembers may be configured to attach to one or more side members to form a frame of the recliner. The crossmembers may be configured to secure one or more components of the recliner. For example, the crossmembers may secure one or more cushions of the recliner to one or more frames. The crossmembers may include one or more attachment points to connect to and/or receive a portion of one or more side rails. The crossmembers may attach directly to one or more side rails. The crossmembers may be positioned substantially perpendicular to one or more side rails. The crossmembers may be positioned at an angle other than substantially perpendicular relative to one or more side rails. The crossmembers and one or more side rails may create any angle. The angle may be about 50 degrees or more, about 60 degrees or more, about 70 degrees or more, or about 80 degrees or more. The angle may be about 130 degrees or less, about 120 degrees or less, about 110 degrees or less, or about 100 degrees of less. The crossmembers may have a shape substantially similar to one or more side rails. The crossmembers may have a shape dissimilar to the side rails. The crossmembers may include one or more supports for additional stiffness. For example, the crossmembers may include one or more legs that contact the ground to substantially eliminate flex of the crossmembers, one or more side rails, or both. The crossmembers may be made of a material similar to the one or more side rails or different. The crossmembers may be solid or may be hollow. The crossmembers may have one or more open sides. The crossmembers may include one or more bearings to receive one or more spindles, shafts, or both of one or more additional frames. The one or more bearings may be a linear ball bearing, a recirculating ball bearing, a roller bearing, other bearing, or a combination thereof. The crossmembers may include one or more support members or one or more joints to increase structural integrity of the crossmembers. The one or more support members may include hems, joints, gussets, junctions, unions, or a combination thereof.

One or more legs may support the crossmembers, one or more side rails, or both. The legs may function to provide structural support to the crossmembers, one or more side rails, or both (e.g., to substantially prevent flex of the crossmembers, one or more side rails, or both). The legs may contact one or more supporting surfaces supporting the recliner. The legs may be connected to the crossmembers, one or more side rails, or both. The legs may be connected via one or more fasteners, one or more adhesives, or both. The legs may be any size or shape. A plurality of legs may be secured to the crossmembers, one or more side rails, or both. The legs may be connected to any surface of the crossmembers, one or more side rails, or both. The legs may be stationary or may be movable. For example, the legs may be stationary and configured to maintain a desired position of the recliner or one or more frames of the recliner. Alternatively, the legs may include one or more wheels so that the legs are configured to move one or more sections of the recliner (e.g., a cushion frame, a base frame, a recliner frame, or a combination thereof). The one or more wheels may be any type of wheel that allows for movement of the recliner or one or more frames of the recliner. The legs may be adjustable to adjust a height, pitch, or both of the recliner or one or more frames of the recliner. The legs may be collapsible. A plurality of stationary legs and a plurality of moveable legs may be secured to the recliner. For example, a pair of stationary legs may support a base frame of the recliner while a pair of moveable legs may support and allow for movement of a cushion frame relative to the base frame.

The base frame may function to provide a stationary base of support for the recliner. The base frame may be configured to support one or more additional frames of the recliner. For example, the base frame may movably support a cushion frame, a backrest frame, or both. The cushion frame may extend, retract, or both from a position of the base frame. Additionally, the backrest frame may pivotally or positionally move relative to a position of the base frame. The base frame may comprise one or more side rails, one or more crossmembers, or both. For example, a pair of crossmembers may extend between a pair of side rails to form a substantially rectangular shape. The base frame may include one or more spindles to guide one or more additional frames. The base frame may include one or more bearings to guide one or more shafts of additional frames. For example, the base frame may include a plurality of linear ball bearings that receive and guide a plurality of shafts of the cushion frame. The one or more shafts may align the cushion frame and the base frame so that the cushion frame moves in a substantially axial direction relative to the base frame. The base frame may include one or more attachment points for the backrest frame, the cushion frame, one or more recliner mechanisms, or a combination thereof. For example, each side rail of the base frame may include a mounting plate that abuts an associated recliner mechanism so that the recliner mechanism can be secured to the mounting plate via one or more fasteners.

The mounting plates may function to secure one or more recliner mechanisms to the base frame. The mounting plates may be integrally formed with one or more side rails of the base frame, one or more crossmembers of the base frame, or both. The mounting plates may be a separate component that is directly or indirectly connected to the base frame. The mounting plates may include one or more attachment points to secure the one or more recliner mechanisms. For example, the mounting plates may include a plurality of threaded holes to secure a guide plate of a recliner mechanism via a plurality of threaded fasteners. The mounting plates may project from a surface of one or more side rails of the base frame, one or more crossmembers of the base frame, or both. The mounting plates may be structurally rigid or may move relative to the base frame. For example, the mounting plates may be secured to the base frame via one or more hinges so that the mounting plates may be collapsible for transportation of the base frame prior to assembly of the recliner. The mounting plate may secure one or more additional components of the recliner, such as the backrest frame, the cushion frame or both.

The base frame may also include one or more spindles. The one or more spindles may function to movably engage one or more additional frames of the recliner and drive movement of the one or more additional frames. The spindles may span between a pair of crossmembers of the base frame, a pair of side rails of the base frame, or a combination thereof. The spindles may be movably engaged to the base frame so that the spindles may rotate in a desired direction (e.g., clockwise, counterclockwise, or both). The spindles may include one or more threads to guide one or more bearings of the cushion frame, the backrest frame, or both. For example, a recirculating ball bearing of the cushion frame may be positioned around a spindle of the base frame so that, as the spindle rotates, the recirculating ball bearing moves along threading of the spindle, thereby moving the cushion frame in an extension direction (i.e., a direction away from the base frame), in a retraction direction (i.e., a direction towards the base frame), or both. The spindle may be manually rotated via one or more gears, one or more levers, or both. The spindle may be configured to rotate by mounting one or more terminal ends of the spindle to bearings secured to one or more side rails of the base frame, crossmembers of the base frame, or both. Rotation of the spindle may be electrically actuated via an electromechanical unit.

The electromechanical unit may function to drive one or more spindles of the base frame. The electromechanical unit may rotate the one or more spindles in a clockwise direction, a counterclockwise direction, or both. The electromechanical unit may be battery operated or may be powered by an external electrical power source (e.g., a wall outlet). The electromechanical unit may be secured to one or more side rails, crossmembers, or both of one or more frames of the recliner. For example, the electromechanical unit may be secured to a crossmember of the base frame so that the electromechanical unit remains stationary during moving of one or more additional frames of the recliner. The electromechanical unit may be a direct-drive motor. The electromechanical unit may indirectly drive the spindle via one or more belts, bands, or both. The electromechanical unit may include one or more gears or may be gearless. The electromechanical unit may be a brushless motor. The electromechanical unit may be an AC motor or a DC motor. The electromechanical unit may drive one or more spindles to extend and/or retract a cushion frame relative to the base frame. The electromechanical unit may be removable for serviceability. The electromechanical unit may prevent back-drive of one or more spindles to prevent unwanted movement of the recliner during user operation. The electromechanical unit may provide sufficient torque to rotate one or more spindles and drive movement of the recliner. The electromechanical unit may drive movement of the recliner via an input received by the electromechanical unit from a controller.

The controller may function to control movement of the electromechanical unit. The controller may operate to control reclining of the recliner. The controller may be directly or indirectly connected to the electromechanical unit. For example, the controller may be connected to the electromechanical unit via one or more wires. The controller may provide power to the electromechanical unit. For example, the controller may be connected to an external power source (e.g., a wall outlet) via a controller input connected to the controller via wires. The controller may then receive the power via the controller input and output the power via a power output connected to the electromechanical unit. The controller input and output may be connected to the controller via one or more wires. The controller input and output may be any connector that may connect to the electromechanical unit, an external power source, or both. The controller may include a printed circuit board. The printed circuit board may include one or more power switching devices. The one or more power switching devices may be a metal-oxide semiconductor field-effect transistor (MOSFET); transistor; insulated gate bipolar transistor (IGBT); rectifier; triode for alternating current (TRIAC); bipolar junction transistor (BJT); or a combination thereof. The printed circuit board may include one or more capacitors; one or more resistors; one or more diodes; one or more inductors; one or more microprocessors; one or more switches; one or more thermistors; or a combination thereof. The controller may include memory, a processor, a motor controller, a position sensor, a network interface, terminal block, power source, wired power source, capacitor, zone selector, or a combination thereof. The controller may be directly attached to or abutting the electromechanical unit. For example, the controller may be located within a housing of the electromechanical unit. Alternatively, the controller may be housed within a separate controller housing and connected to the electromechanical unit via one or more wires. A plurality of controllers may operate the electromechanical unit. The controller may operate the electromechanical unit via input received by one or more electronic devices.

The electronic device may function to provide an input to the controller. The electronic device may function as a user interface to extend the cushion frame, retract the cushion frame, recline the backrest frame, or a combination thereof. The electronic device may communicate with the controller, the electromechanical unit, or both. The electronic device may require user input to communicate with the controller. The electronic device may communicate with the controller via one or more wires or may communicate wirelessly. For example, the electronic device may be a wireless device having a transmitter that transmits a command from the electronic device to a receiver of the controller. The electronic device may be any device that transmits a signal, receives a signal, or both from the controller, the electromechanical unit, or both. The electronic device may include a printed circuit board (PCB), a transmitter, a microcontroller, an antenna, a data storage unit, or a combination thereof. The electronic device may be a computer, smartphone, tablet, smart watch, remote, wireless fob, or a combination thereof. For example, a user may download a software application to their personal smartphone to control movement of the recliner. Alternatively, the electronic device may be a remote connected to the controller via a wire so that a user may operate the recliner via one or more buttons on the remote (e.g., an extend button, a retract button, or both). The electronic device may be battery powered or may be powered by the recliner. The electronic device may be customizable based on a user's needs. For example, the electronic device may be configured with one or more programmable preset recliner positions so that a user may select a specific position of the cushion frame from the electronic device memory as opposed to articulating the recliner to a desired position.

The cushion frame may function to support one or more cushions. The cushion frame may function to provide an extendable cushion for one or more users. The cushion frame may be configured to movably engage the base frame. For example, the cushion frame may extend, retract, or both relative to the base frame via one or more spindles engaging a recirculating ball bearing secured on one or more crossmembers of the cushion frame. The cushion frame may include one or more supports. For example, the cushion frame may include one or more moveable legs having one or more wheels so that the cushion frame may extend, retract, or both relative to the base frame. The cushion frame may be configured to move substantially axially relative to the base frame, the backrest frame, or both. The cushion frame and the base frame may be substantially coaxial, flush, or both. The cushion frame may be substantially parallel to the base frame, the backrest frame, or both. The cushion frame may comprise one or more side rails, one or more crossmembers, or both. For example, the cushion frame may include a pair of crossmembers extending between a pair of side rails to form a substantially rectangular shape. The rectangular shape may be sized to fit within the confines of the base frame. The cushion frame may comprise one or more side rails, one or more crossmembers, or both that are substantially similar in size and shape to the one or more side rails, one or more crossmembers, or both of the base frame, the backrest frame, or both. Alternatively, the one or more side rails, one or more crossmembers, or both of the cushion frame may differ in size and shape relative to the base frame, the backrest frame, or both. The cushion frame may have one or more protrusions, one or more extensions, or both to secure one or more components. For example, the cushion frame may include a pair of protruding surfaces protruding from a pair of side rails to secure a pair of hook plates. The cushion frame may move in a retraction direction axially towards the base frame. The cushion frame may move in an extension direction axially away from the base frame. One or more shafts within the cushion frame may guide the cushion frame in a substantially axial direction relative to the base frame.

The one or more shafts may function to guide the cushion frame during extension, retraction or both. The one or more shafts may span a length between side rails, crossmembers, or both. The one or more shafts may be structurally rigid. The one or more shafts may secure to the side rails, crossmembers, or both at a substantially right angle. The one or more shafts may mount to the side rails, crossmembers, or both at an angle other than a right angle. For example, the angle may be about 30 degrees or more, about 60 degrees or more, or about 90 degrees or more. The angle may be about 150 degrees or less, about 120 degrees or less, or about 90 degrees or less. The one or more shafts may be substantially linear so that the cushion frame moves in a substantially linear direction relative to the base frame, the backrest frame, or both. The one or more shafts may include curvature so that the cushion frame moves in a direction other than substantially linear. The one or more shafts may be received by one or more bearings of the base frame, the backrest frame, or both. For example, a plurality of shafts may be received by a set of linear ball bearings secured to a crossmember of the base frame so that the shafts are guided in a substantially axial direction relative to the base frame through the linear ball bearings. As the one or more shafts guide the cushion frame, one or more hook plates extending from the cushion frame may engage one or more recliner mechanisms.

The hook plate may function to engage a recliner mechanism of the recliner. The hook plate may engage the recliner mechanism during movement of the cushion frame in an extension direction (i.e., a direction substantially axially away from the base frame). The hook plate may protrude from a surface of one or more side rails, one or more crossmembers, or both of the cushion frame. The hook plate may be integrally formed with one or more side rails, one or more crossmembers, or both of the cushion frame. Alternatively, the hook plate may be a secondary piece that is attached to a surface of the cushion frame. For example, the hook plate may be secured at one or more attachment points to the cushion frame via one or more fasteners, adhesives, or both. The hook plate may be positioned anywhere along the cushion frame so that the hook plate engages the recliner mechanism. A plurality of hook plates may be used to engage a plurality of recliner mechanisms. Alternatively, a plurality of hook plates may be used to engage a single recliner mechanism, a plurality of recliner mechanisms may be engaged by a single hook plate, or both. The hook plate may include one or more engaging features, receiving features, or both to engage the recliner mechanism. For example, the hook plate may include a guide slot that receives and guides an engaging feature of the recliner mechanism. The engaging feature may be a bearing (e.g., a linear ball bearing, a roller bearing, a recirculating ball bearing, or a combination thereof), a hook, a latch, a protrusion, a fastener, or a combination thereof. The guide slot may be any size and shape that may be configured to receive one or more engaging features of the recliner mechanism. The guide slot may include an open end along a terminal side of the hook plate so that the one or more engaging features of the recliner mechanism may enter the guide slot. The guide slot may include a closed end opposing the open end so that, when the one or more engaging features of the recliner mechanism enter the guide slot and reach the closed end, the recliner mechanism begins to articulate, causing one or more additional frames (e.g., a backrest frame) to move. The guide slot of the hook plate may be any size and shape to receive one or more engaging features. The hook plate may engage the recliner mechanism during movement of the cushion frame in an extension direction, a retraction direction (i.e., a direction directly opposing the extension direction moving substantially axially towards the base frame), or both. The hook plate may engage the recliner mechanism in an extension direction and disengage the recliner mechanism in a retraction direction, or vice versa. The hook plate may include one or more abutments, one or more structural supports, or both to maintain a position of the hook plate during engagement, disengagement, or both. The hook plate may engage a recliner mechanism so that, as the cushion frame moves in an extension direction, the hook plate causes articulation of the recliner mechanism, which in turn reclines a backrest frame of the backrest.

The backrest frame may function as a back support for one or more users of the recliner. The backrest frame may be configured to move anywhere between an upright position substantially perpendicular to the cushion frame, base frame, or both, and a fully reclined position substantially coplanar with the cushion frame, the base frame, or both. For example, the backrest frame may move from an upright position where one or more users may be in a seated position (e.g., a chair position) to a fully reclined position where one or more users may lay in a fully prone position (e.g., a bed position). The backrest frame may be configured to move simultaneously with extension of the cushion frame, retraction of the cushion frame, or both via one or more recliner mechanisms. For example, the backrest frame may move in a reclining direction during extension of the cushion frame and the backrest frame may move in a direction opposing the reclining direction during retraction of the cushion frame. The backrest frame may move independently of movement of the cushion frame, or vice versa. For example, the cushion frame may extend between an initial position and a desired extension position free of engagement with the recliner mechanism. As the cushion frame moves beyond the desired extension position, the hook plates of the cushion frame may begin to engage the recliner mechanisms and consequentially the backrest frame. Therefore, the backrest frame and the cushion frame of the recliner may move both independently and synchronously based on a position of the cushion frame. The backrest frame may move in a direction substantially axial with the cushion frame, the base frame, or both. The backrest frame may pivot about one or more axes relative to the cushion frame, the base frame, or both. The backrest frame may move in a linear direction relative to the base frame, the cushion frame or both and pivot about one or more axes. For example, the backrest frame may move in a colinear direction with the cushion frame via a pair of recliner mechanisms while simultaneously pivot about a plurality of pivot points of the recliner mechanisms until the backrest frame and cushion frame are substantially coplanar. The backrest frame may support one or more cushions. The backrest frame may include one or more supports. For example, the backrest frame may include one or more protruding legs so that, when the backrest frame is reclined into a fully reclined position, the one or more protruding legs contact a surface beneath the recliner. The backrest frame may comprise one or more side rails, one or more crossmembers, or both. For example, the backrest frame may include a pair of crossmembers extending between a pair of side rails to form a substantially rectangular shape. The backrest frame may have a shape similar or dissimilar to the cushion frame, the base frame, or both. The backrest frame may directly attach to one or more recliner mechanisms or may be secured to the one or more recliner mechanisms via an intermediate bracket. For example, the backrest frame may be directly attached to a pair of recliner mechanisms on opposing ends of the backrest frame via backrest engaging features of the recliner mechanisms.

The recliner mechanism may function to recline a backrest frame of the recliner. The recliner mechanism may articulate a backrest frame in one or more directions. The recliner mechanism may be configured to pivot the backrest frame, move the backrest frame in a substantially linear direction, rotate the backrest frame, or a combination thereof. The recliner mechanism may include one or more arms, one or more pivot points, one or more bearings, or a combination thereof to move the backrest frame. The recliner mechanism may move the backrest frame in a substantially coaxial direction with the cushion frame, the base frame, or both. The recliner mechanism may pivot the backrest frame about one or more pivots between an upright position and a fully reclined position. The recliner mechanism may be directly or indirectly attached to the backrest frame, the base frame, the cushion frame, or a combination thereof. For example, the recliner mechanism may be fixedly attached to a mounting plate of the base frame and movably engaged to the cushion frame, the base frame, or both. A plurality of recliner mechanisms may be configured to move the backrest frame. For example, a pair of recliner mechanisms including a left-hand recliner mechanism and a right-hand recliner mechanism that may attach to opposing sides of the backrest frame and the pair of recliner mechanisms may synchronously move relative to each other. The recliner mechanism may include one or more structurally rigid parts, one or more movable parts, or a combination thereof. For example, the recliner mechanism may include a backrest engaging feature that fixedly connects to a backrest frame.

The backrest engaging feature may function to connect the backrest frame to the recliner mechanism. The backrest engaging feature may connect to one or more side rails, one or more crossmembers, or both of the backrest frame. The backrest engaging feature may receive a portion of the backrest frame, or vice versa. The backrest engaging feature may include one or more attachment points to connect to the backrest frame. The attachment points may be a hole, slot, aperture, protrusion, engaging feature, or a combination thereof. The backrest engaging feature may be connected to the backrest frame via one or more fasteners. The one or more fasteners may be a bolt, screw, nail, rivet, other mechanical fastener, or a combination thereof. The backrest engaging feature may be connected to the backrest frame free of fasteners. For example, the backrest engaging feature may be welded or adhered to the backrest frame. The backrest engaging feature may be structurally rigid. The backrest engaging feature may be movably secured to the backrest frame or fixedly secured to the backrest frame. For example, the backrest engaging feature may be fixedly secured to the backrest frame at a first end and fixedly secured to a backrest arm of the recliner mechanism at an opposing second end via a spacer.

The spacer may function to space apart the backrest engaging feature and the backrest arm. The spacer may function may function to provide an intermediate interface between the backrest engaging feature and the backrest arm. The spacer may be configured to extend through the armrest to connect the backrest engaging feature and the backrest arm. For example, the backrest arm may be locked in an enclosed armrest and the backrest engaging feature may be positioned outside of the armrest so that the spacer may extend through an opening in the armrest to connect the backrest engaging feature and the backrest arm. The spacer may be configured to space apart any components of the recliner. The spacer may fill a gap between the backrest engaging feature and the backrest arm. The spacer may include one or more holes to receive one or more fasteners of the backrest engaging feature, the backrest arm, or both. For example, the spacer may include one or more through-holes so that one or more fasteners may extend from the backrest engaging feature, through the through-holes of the spacer, and into the backrest arm. The spacer may be compressible or may be structurally rigid. The spacer may be any material, size, shape, or a combination thereof. The spacer may include one or more lubricants to allow movement between the spacer and one or more components of the recliner mechanism. The spacer may be configured to position the backrest frame relative to the recliner mechanism, the base frame, the cushion frame, or a combination thereof. For example, the backrest frame may have a width less than a gap between opposing recliner mechanism and a pair of spacers may be positioned between opposing backrest engaging features and the backrest frame so that the backrest frame is positioned substantially centered with the cushion frame, the base frame, or both. The spacer may be configured to align one or more attachment points of the backrest engaging feature with one or more attachment points of the backrest arm.

The backrest arm may function to work in conjunction with one or more additional arms to articulate the backrest frame. The backrest arm may be configured to directly move the backrest frame. The backrest arm may pivot about one or more pivot points of the recliner mechanism. For example, the backrest arm may fixedly attach to the backrest engaging feature at a first end and pivot about a backrest arm pivot at an opposing second end. The backrest arm may be substantially linear. The backrest arm may include one or more angles. For example, the backrest arm may include one or more bends and the one or more bends may have an angle. The angle may be about 30 degrees or more, about 45 degrees or more, about 60 degrees or more, or about 75 degrees or more. The angle may be about 135 degrees or less, about 120 degrees or less, about 105 degrees or less, or about 90 degrees or less. The backrest arm may be any size and shape to connect the backrest engaging feature, the spacer, or both to the backrest arm. The backrest arm may include one or more contours, one or more protrusions, one or more holes, or a combination thereof. The backrest arm may include one or more attachment points to secure the backrest arm to the backrest lock arm, the recliner arm, or both. The backrest lock arm may be slidably engaged, pivotally engaged, fixedly engaged, or a combination thereof to the backrest arm, the recliner arm, or both. The backrest lock arm may include one or more engagement features to engage the cushion frame, the guide plate, or both. The one or more engagement features may be a hook, latch, arm, tooth, gear, fastener, protrusion, extension, bearing, hole, or a combination thereof. The bearing may be a roller bearing, a linear ball bearing, other bearing, or a combination thereof. The one or more engagement features may be located anywhere along the backrest lock arm. The one or more engagement features may be located near a terminal end of the backrest lock arm or one or more points between opposing terminal ends. For example, the backrest lock arm may include a first engagement feature near a distal end that engages a guide slot of a hook plate connected to the cushion frame and a second engagement feature near a proximal end that engages a guide slot of the guide plate. The one or more engagement features may protrude from one or more surfaces of the backrest lock arm. The one or more engagement features may extend from one or more peripheral edges of the backrest lock arm. The backrest arm may be connected to one or more additional arms, such as a recliner arm, a backrest lock arm, or both. The backrest arm may directly or indirectly move based on retraction of the cushion frame, extension of the cushion frame, or both. For example, as the cushion frame moves in the extension direction, a backrest lock arm pivotally engaged to the backrest arm may engage a guide slot of a hook plate of the cushion frame. When the backrest lock arm is fully engaged in the guide slot, the backrest lock arm may extend in the extension direction, thereby extending the backrest arm in the extension direction. Alternatively, as the cushion frame moves in a retraction direction, the backrest lock arm moves in the retraction direction, causing the backrest arm to also move in the retraction direction. As the backrest lock arm extends or retracts, the backrest arm may extend, retract, or both. The backrest arm may pivot about one or more pivots as the backrest lock arm extends, retracts, or both. The backrest arm may movably secure the backrest lock arm during engagement with a hook plate of the cushion frame, during disengagement with a hook plate of the cushion frame, or both. The backrest arm may pivot about a backrest arm pivot.

The backrest arm pivot may function to pivotally engage the backrest arm relative to one or more additional components of the recliner mechanism. The backrest arm pivot may pivotally engage the backrest arm with the backrest lock arm, the recliner arm, the backrest frame, the cushion frame, or a combination thereof. The backrest arm pivot may be an attachment point between the backrest arm and the backrest lock arm, the recliner arm, or both. The backrest arm pivot may allow a desired rotation (i.e., pivoting) of the backrest arm about the backrest arm pivot. The rotation may be about 45 degrees or more, about 90 degrees or more, about 135 degrees or more, or about 180 degrees or more. The rotation may be about 360 degrees or less, about 315 degrees or less, about 270 degrees or less, or about 225 degrees or less. The backrest arm pivot may include one or more bumpers, one or more stoppers, or both to tune a rotation of the backrest arm. The backrest arm pivot may be any connection point between the backrest arm and the backrest lock arm, the recliner arm, or both. The backrest arm may have a plurality of backrest arm pivots. The backrest arm may pivot about the backrest arm pivot based on movement of a backrest lock arm.

The backrest lock arm may function to engage a cushion frame of the recliner. The backrest lock arm may function to connect the recliner mechanism to a cushion frame. The backrest lock arm may engage one or more hook plates of a cushion frame so that, as the cushion frame extends, retracts, or both the backrest lock arm may extend, retract, or both in a direction substantially similar to a direction of the cushion frame. As the backrest lock arm extends, retracts, or both the recliner mechanism may articulate to move the backrest frame. For example, as the backrest lock arm engages a guide slot of a hook plate of the cushion frame, the backrest lock arm extends in an extension direction substantially parallel to an extension direction of the cushion frame. As the backrest lock arm continues to move in an extension direction, the backrest lock arm may articulate the backrest arm, a recliner, or both about one or more pivot points, thereby causing the backrest frame to move in a reclining direction. The backrest lock arm may include one or more attachments points to secure the backrest lock arm to the backrest arm, the recliner arm, or both. The backrest lock arm may be slidably engaged, pivotally engaged, fixedly engaged, or a combination thereof to the backrest arm, the recliner arm, or both. The backrest lock arm may include one or more engagement features to engage the cushion frame, the guide plate, or both. The one or more engagement features may be a hook, latch, arm, tooth, gear, fastener, protrusion, extension, bearing, hole, or a combination thereof. The bearing may be a roller bearing, a linear ball bearing, other bearing, or a combination thereof. The one or more engagement features may be located anywhere along the backrest lock arm. The one or more engagement features may be located near a terminal end of the backrest lock arm or one or more points between opposing terminal ends. For example, the backrest lock arm may include a first engagement feature near a distal end that engages a guide slot of a hook plate connected to the cushion frame and a second engagement feature near a proximal end that engages a guide slot of the guide plate. The one or more engagement features may protrude from one or more surfaces of the backrest lock arm. The one or more engagement features may extend from one or more peripheral edges of the backrest lock arm. The backrest lock arm may be any size, shape, or both. The backrest lock arm may include one or more angles, one or more bends, one or more contours, or a combination thereof. The backrest lock arm may be free of one or more bends, one or more contours, one or more angles, or both. For example, the backrest lock arm may be substantially linear. The backrest lock arm may be structurally rigid or may be flexible. The backrest lock arm may include one or more strengthening ribs, one or more gussets, or both. The backrest lock arm may be compressible, expandable, or both. The backrest lock arm may vary in thickness. The backrest lock arm may pivot about a backrest lock arm pivot.

The backrest lock arm pivot may function to pivotally engage the backrest lock arm relative to one or more additional components of the recliner mechanism. The backrest lock arm pivot may pivotally engage the backrest lock arm with the backrest arm, the recliner arm, the backrest frame, the cushion frame, or a combination thereof. The backrest lock arm pivot may be an attachment point between the backrest lock arm and the backrest arm, the recliner arm, or both. The backrest lock arm pivot may allow a desired rotation (i.e., pivoting) of the backrest lock arm about the backrest lock arm pivot. The rotation may be about 45 degrees or more, about 90 degrees or more, about 135 degrees or more, or about 180 degrees or more. The rotation may be about 360 degrees or less, about 315 degrees or less, about 270 degrees or less, or about 225 degrees or less. The backrest lock arm pivot may include one or more bumpers, one or more stoppers, or both to tune a rotation of the backrest lock arm. The backrest lock arm pivot may be any connection point between the backrest lock arm and the backrest arm, the recliner arm, or both. The backrest lock arm may have a plurality of backrest lock arm pivots. The backrest lock arm may pivot about the backrest lock arm pivot during extension of the cushion frame, retraction of the cushion frame, or both to articulate the backrest arm, the recliner arm, or both.

The recliner arm may function to movably attach the backrest arm to a guide plate of the recliner mechanism. The recliner arm may function to engage the backrest arm, backrest lock arm, or both. The recliner arm may work in conjunction with the backrest arm, the backrest lock arm, or both to articulate the backrest frame. The recliner arm may be configured to indirectly move the backrest frame. The recliner arm may pivot about one or more pivot points of the recliner mechanism. For example, the recliner arm may pivot about a primary pivot near a first end and pivot about a backrest arm pivot near an opposing second end. The recliner arm may be substantially linear. The recliner arm may include one or more bends, one or more curves, or both. The one or more bends, one or more curves, or both may have one or more angles. The angle may be about 30 degrees or more, about 45 degrees or more, about 60 degrees or more, or about 75 degrees or more. The angle may be about 135 degrees or less, about 120 degrees or less, about 105 degrees or less, or about 90 degrees or less. The recliner arm may be any size and shape to interconnect the backrest arm, the backrest lock arm, or both to a guide plate. The recliner arm may include one or more contours, one or more protrusions, one or more holes, or a combination thereof. The recliner arm may include one or more attachment points to secure the recliner arm to a guide plate, the backrest arm, the backrest lock arm, or a combination thereof. The recliner arm may be slidably engaged, pivotally engaged, fixedly engaged, or a combination thereof to a guide plate, the backrest arm, the backrest lock arm, or a combination thereof. The recliner arm may include one or more engagement features to engage a guide plate, the backrest arm, the backrest lock arm, or a combination thereof. The one or more engagement features may be a hook, latch, arm, tooth, gear, fastener, protrusion, extension, bearing, hole, or a combination thereof. The bearing may be a roller bearing, a linear ball bearing, other bearing, or a combination thereof. The one or more engagement features may be located anywhere along the recliner arm. The one or more engagement features may be located near a terminal end of the recliner arm or one or more points between opposing terminal ends. The recliner arm may directly or indirectly move based on retraction of the cushion frame, extension of the cushion frame or both. For example, as the cushion frame moves in the extension direction, a backrest lock arm pivotally engaged to the backrest arm may engage a guide slot of a hook plate of the cushion frame. When the backrest lock arm is fully engaged in the guide slot, the backrest lock arm may extend in the extension direction, thereby extending the backrest arm in the extension direction. As the backrest arm moves in the extension direction, the recliner arm may pivot about a primary pivot, extend in the extension direction, or both. The recliner arm may pivot about a primary pivot positioned on a guide plate of the recliner mechanism.

The primary pivot may function to pivotally engage the recliner arm relative to the guide plate. The primary pivot may be an attachment point between the recliner arm and the guide plate. For example, the guide plate may be fixedly attached to the base frame and the recliner arm may be movably attached to the guide plate at the primary pivot view one or more fasteners. The primary pivot may allow a desired rotation (i.e., pivoting) of the recliner arm about the primary pivot. The rotation may be about 45 degrees or more, about 90 degrees or more, about 135 degrees or more, or about 180 degrees or more. The rotation may be about 360 degrees or less, about 315 degrees or less, about 270 degrees or less, or about 225 degrees or less. The primary pivot may include one or more bumpers, one or more stoppers, or both to tune a rotation of the recliner arm. The primary pivot may be any connection point between the recliner arm and the guide plate, the base frame, or both. The recliner arm may have a plurality of primary pivots. The recliner arm may be fixed to the guide plate so that, as the recliner arm articulates, a proximal end of the recliner arm remains secured to the guide plate.

The guide plate may function to guide one or more engagement features of the recliner arm, the backrest arm, the backrest lock arm, or a combination thereof. The guide plate may function to secure the recliner mechanism to the base frame. The guide plate may attach to any location along the base frame. For example, the guide plate may be secured to one or more mounting plates projecting from a surface of the base frame. A single guide plate may secure each recliner mechanism to the base frame. Alternatively, a plurality of guide plates may secure a singe recliner mechanism to the base frame. The guide plate may act as an intermediate bracket between the recliner arm and the base frame. The guide plate may include one or more guide slots that guide one or more engagement features of the recliner arm, the backrest arm, the backrest lock arm, or a combination thereof. The guide slots may be any size and shape to receive the one or more engagement features of the recliner arm, the backrest arm, the backrest lock arm, or a combination thereof and allow for a desired travel distance of the one or more engagement features. For example, the guide plate may include a first substantially linear guide slot to receive a first roller bearing of the backrest arm, and a second curved guide slot to receive a second roller bearing of the backrest arm. The guide slots of the guide plate may include one or more open ends, one or more closed ends, or both. For example, a first guide slot may include a pair of opposing closed ends to retain a first roller bearing of the backrest arm in the first guide slot while a second guide slot may include an open end and a closed end so that a second roller bearing of the backrest arm may engage and disengage the second guide slot via the closed end. The guide plate may include one or more contours, one or more projections, or both. The guide plate may be mounted to the base frame via one or more holes in the guide plate. The guide plate may include a plurality of holes near one or more peripheral edges so that the guide plate is cantilevered from a mounting plate of the base frame. The guide plate may be made from the same material as the base frame, the backrest arm, the backrest lock arm, the recliner arm, or a combination thereof. The guide plate may be made from a different material. For example, the base frame may comprise a plurality of aluminum tubular crossmembers and side rails while the guide plate is a stamped steel. The guide plate may be structurally rigid. A plurality of guide plates may support a plurality of recliner mechanisms. For example, the recliner may include opposing left-hand and right-hand recliner mechanisms on opposing sides of the base frame and each recliner mechanism may be secured to the base frame via a guide plate. The guide plate may be housed in an armrest.

The armrest may function to house the guide plate, one or more components of the reclining mechanism, or both. The armrest may function to provide support to one or more peripheral limbs of one or more users of the recliner. The armrest may include a frame, a casing, or both. For example, the armrest may include a wooden frame for structural support encased in fabric. The frame may be wood, plastic, metal, or a combination thereof. The casing may be a fabric, polymer, glass, wood, metal, or a combination thereof. The armrest may be any size and shape configured to house one or more of the recliner mechanisms. The recliner may include a pair of opposing armrests. The armrests may be fixedly secured to the base frame, the cushion frame, the backrest frame, or a combination thereof. For example, the armrests may be fixedly attached to one or more peripheral edges of the base frame and may remain stationary during extension of the cushion frame, retraction of the cushion frame, reclining of the backrest, or a combination thereof. The armrests may be movably attached to the base frame, the cushion frame, the backrest frame, or a combination thereof. For example, the armrests may be movably secured to opposing sides of the cushion frame so that, as the cushion frame extends, the armrests also extend in a direction substantially similar to the cushion frame. The armrests may be structurally rigid. The armrests may be hollow. One or more supports may extend from the armrest to support the recliner. For example, the armrests may have one or more protruding legs to support the recliner. The armrests may be removable for serviceability of the recliner mechanisms. The armrests may include a removable panel to access the recliner mechanisms. The removable panel may be transparent. The armrests may prevent one or more users from interacting with the recliner mechanisms during articulation of the recliner mechanisms.

Turning now to the figures, FIG. 1 illustrates a perspective view of a recliner 10 in a fully retracted and upright position. The recliner 10 includes a backrest frame 200 selectably and partially pivotally engaged to a cushion frame 300 via recliner mechanisms 400A, 400B mounted and secured in armrests 26 on opposing sides of the backrest frame 200 and the cushion frame 300. The left-hand recliner mechanism 400A and the right-hand recliner mechanism 400B may work in conjunction to extend, retract, or both the backrest frame 200, the cushion frame 300, or both. The recliner mechanisms 400 may be configured to allow the cushion frame 300 to extend, retract, or both relative to the backrest frame 200 while the backrest frame 200 remains stationary in the upright position. As the backrest frame 200 reclines (i.e., pivots), a backrest cushion 18A also reclines until it becomes substantially coplanar with a seat cushion 18B of the cushion frame 300 in a fully-reclined position (see FIGS. 5-7). It should be noted that the recliner mechanisms 400 may be configured to maintain any position of the backrest frame 200 relative to the cushion frame 300 between the upright position and the fully-reclined position. The recliner mechanisms 400 may maintain a position of the backrest frame 200 relative to the cushion frame 300 free of any engagement directly between the backrest frame 200 and the cushion frame 300 so that the backrest frame 200 may remain stationary while the cushion frame 300 is extended, retracted, or both. A plurality of moveable legs 16B may allow the cushion frame 300 to extend, retract, or both via a plurality of wheels 20 secured to the moveable legs 16B. As the cushion frame 300 extends, retracts, or both a plurality of stationary legs 16A may maintain a position of the backrest frame 200, armrests 26, or both.

Figure 2:
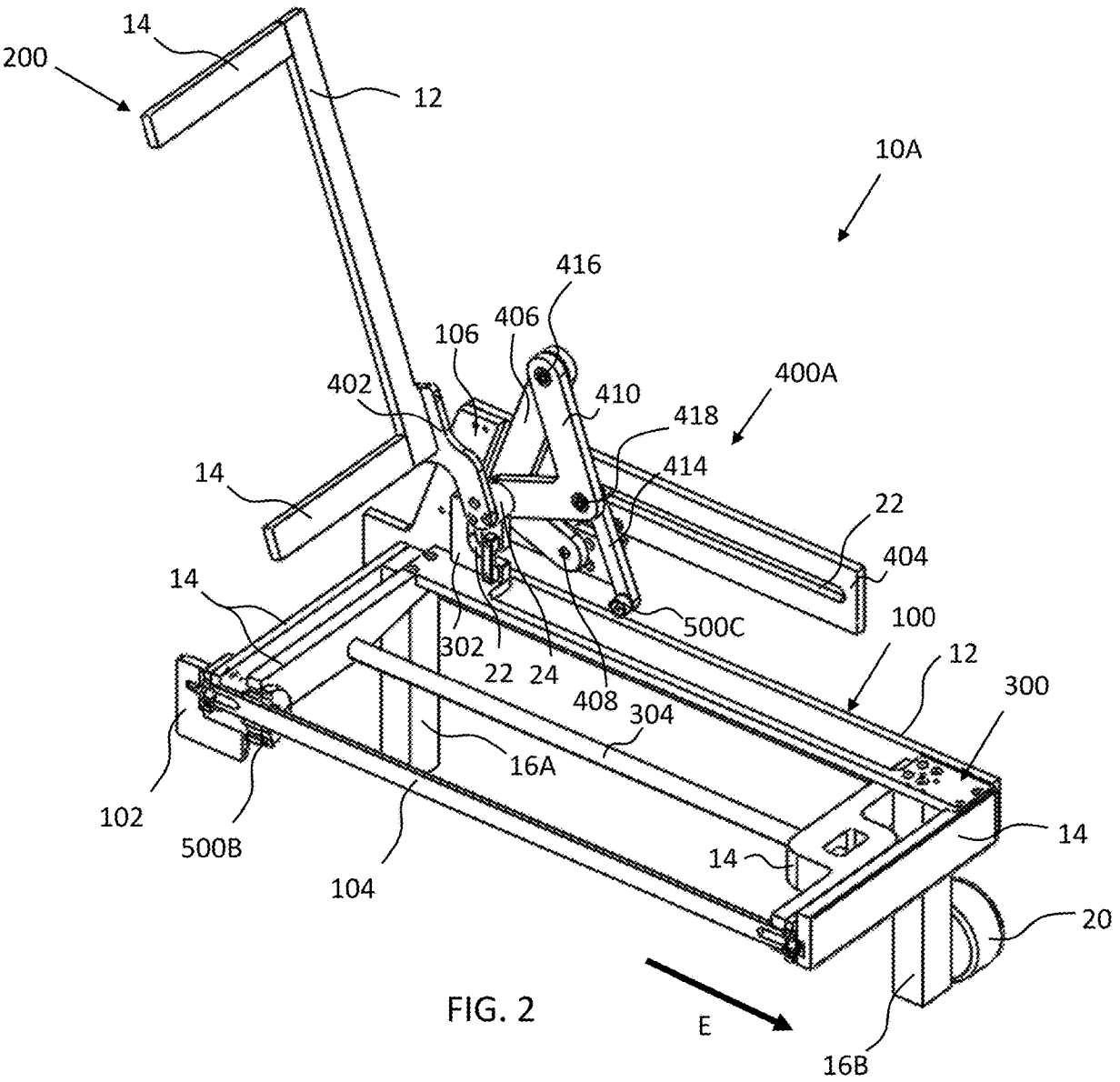
FIG. 2 illustrates a cross-sectional view of a partial recliner frame in a fully retracted and upright position.

FIG. 2 illustrates a cross-sectional view of a partial recliner frame 10A in a fully retracted and upright position. The recliner frame 10A includes a backrest frame 200 selectably and pivotally disengaged from a cushion frame 300 so that the cushion frame 300 may move independently of the backrest frame 200 (e.g., the backrest frame 200 may remain stationary as the cushion frame 300 extends, retracts, or both). The backrest frame 200 and the cushion frame 300 each include opposing side rails 12 connected via a pair of crossmembers 14. The side rails 12 of the backrest frame 200 are each connected to a backrest engaging feature 402 of a recliner mechanism 400. As shown, a left-hand recliner mechanism 400A includes a recliner arm 406, a backrest arm 410, and a backrest lock arm 414 movably connected to a guide plate 404 of the recliner mechanism 400. The recliner arm 406 is pivotally engaged to the backrest arm 410 about a backrest arm pivot 416, the backrest lock arm 414 is pivotally engaged to the backrest arm 410 about a backrest lock arm pivot 418, and the recliner arm 406 is pivotally engaged to the guide plate 404 about a primary pivot 408 so that the recliner mechanism 400 may move the backrest frame 200. The guide plate 404 is mounted to a mounting plate 106 protruding from the siderails 12 of the base frame 100 so that the guide plate 404 and the base frame 100 remain stationary during movement of the recliner 10. The recliner arm 406, the backrest arm 410, and the backrest lock arm 414 are engaged to the backrest frame 200 via a spacer 24 connecting the backrest engaging feature 402 and the backrest arm 410. The recliner frame 10A further includes a base frame 100 having opposing side rails 12 connected via a pair of crossmembers 14. An electromechanical unit 102 drives a spindle 104 rotatably mounted to the base frame 100 to axially move a recirculating ball bearing 500B of the cushion frame 300 in an extension direction (E), thereby moving the cushion frame 300 in the extension direction (E) via a plurality of wheels 20 secured to moveable legs 16B of the cushion frame 300 (see FIGS. 8 and 9). As the cushion frame 300 extends, retracts, or both a plurality of stationary legs 16A may maintain a position of the backrest frame. The cushion frame 300 further includes a pair of shafts 304 extending through linear ball bearings (not shown) located on the crossmember 14 of the base frame 100 to maintain a substantially linear direction of movement of the cushion frame 300. As shown, the backrest frame 200 is disengaged from the cushion 300 as a result of a roller bearing 500C of the backrest lock arm 414 being disengaged with a guide slot 22 of a hook plate 302 mounted to the cushion frame 300. The backrest lock arm 414 may be maintained in a position relative to the guide plate 404 via a plurality of additional roller bearings engaged in guide slots 22 of the guide plate 404, thereby maintaining a position of the backrest frame 200

Figure 3:
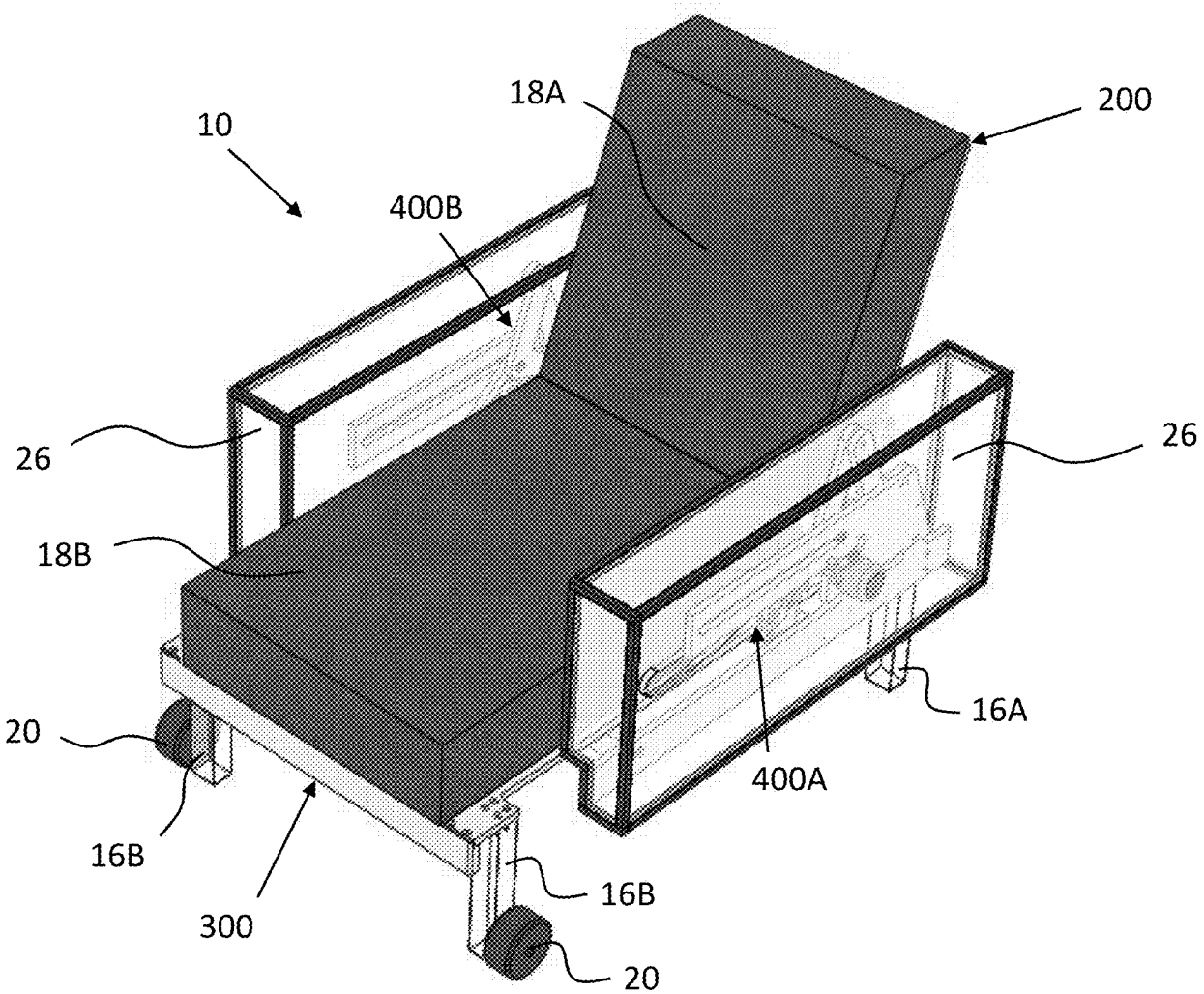
FIG. 3 illustrates a perspective view of a recliner in a semi-extended and upright position.

FIG. 3 illustrates a perspective view of a recliner 10 in a semi-extended and upright position. The recliner 10 includes a backrest frame 200 in an upright position prior to pivotally engaging a cushion frame 300 (see FIG. 4). As shown, the cushion frame 300 may extend independently of the backrest frame 200 prior to the backrest frame 200 engaging a pair or hook plates (not shown) mounted on the cushion frame 300. The cushion frame 300 may continue to extend until the cushion frame 300 engages the backrest frame 200. After engagement, the backrest frame 200 may recline simultaneously with the extension of the cushion frame (see FIGS. 4-7). As the backrest frame 200 reclines (i.e., pivots), a backrest cushion 18A also reclines until it becomes substantially coplanar with a seat cushion 18B of the cushion frame 300 in a fully-reclined position (see FIGS. 5-7). A plurality of moveable legs 16B may allow the cushion frame 300 to extend, retract, or both via a plurality of wheels 20 secured to the moveable legs 16B. As the cushion frame 300 extends, retracts, or both a plurality of stationary legs 16A may maintain a position of the backrest frame 200 (until the backrest frame 200 engages the cushion frame 300), armrests 26, or both. The backrest frame 200 pivotally engages the cushion frame 300 via recliner mechanisms 400A, 400B mounted and secured in the armrests 26 positioned on opposing sides of the backrest frame 200 and the cushion frame 300.

Figure 4:
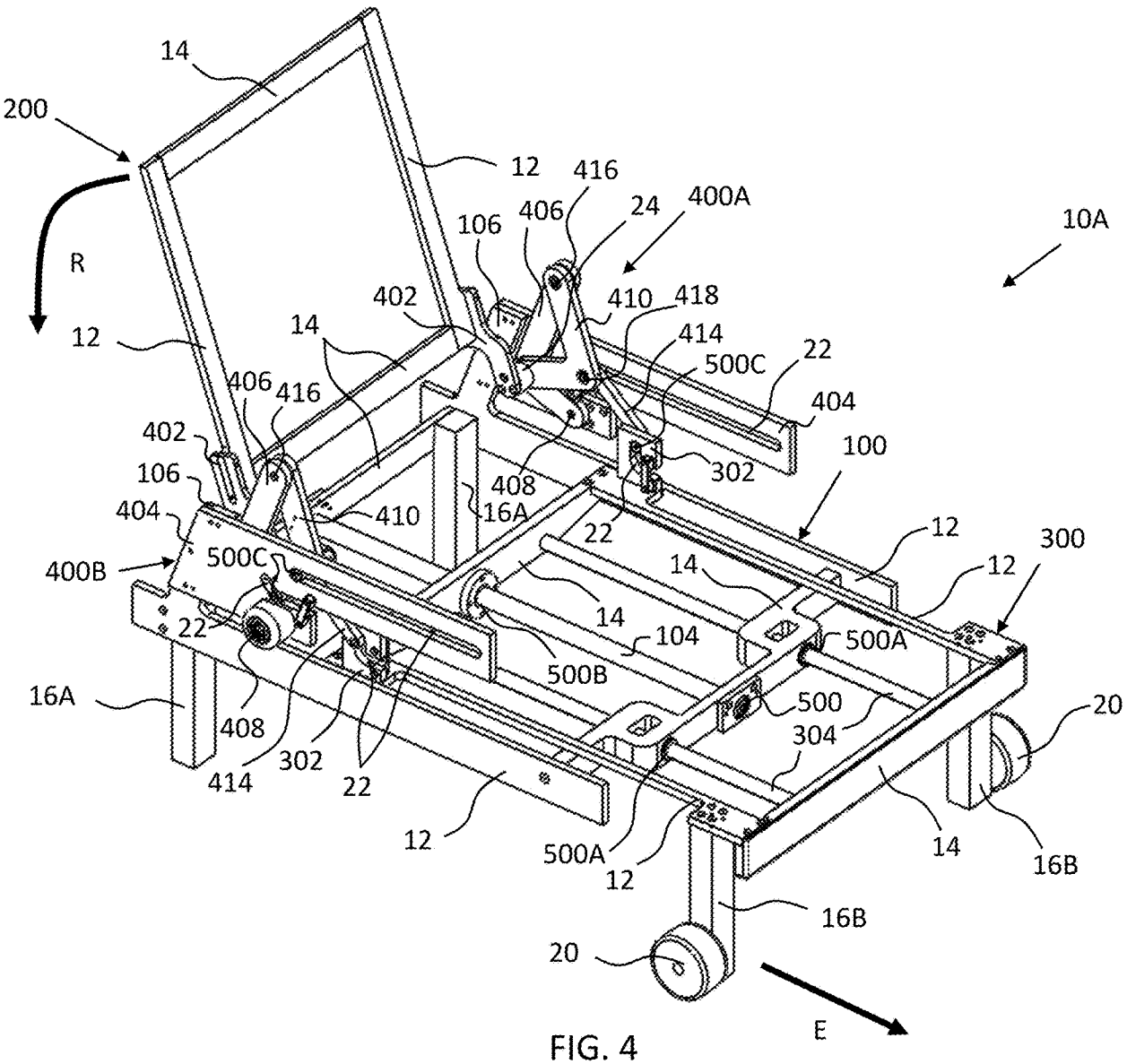
FIG. 4 illustrates a perspective view of a recliner frame in a semi-extended and upright position.

FIG. 4 illustrates a perspective view of a recliner frame 10A in a semi-extended and upright position. The recliner frame 10A includes a backrest frame 200 in an upright position pivotally engaged to a cushion frame 300. The backrest frame 200 and the cushion frame 300 each include opposing side rails 12 connected via a pair of crossmembers 14. The side rails 12 of the backrest frame 200 are each connected to a backrest engaging feature 402 of a recliner mechanism 400. As shown, a left-hand recliner mechanism 400A and a right-hand recliner mechanism 400B each include a recliner arm 406, a backrest arm 410, and a backrest lock arm 414 movably connected to a guide plate 404 of the recliner mechanism 400. The recliner frame 10A further includes a base frame 100 having opposing side rails 12 connected via a pair of crossmembers 14. An electromechanical unit drives a spindle 104 mounted between the electromechanical unit and a bearing 500 of the base frame 100 to move a recirculating ball bearing 500B of the cushion frame 300 in an extension direction (E), thereby moving the cushion frame 300 in the extension direction (E) via a plurality of wheels 20 secured to moveable legs 16B of the cushion frame 300 (see FIGS. 8 and 9). The cushion frame 300 further includes a pair of shafts 304 extending through linear ball bearings 500A located on the crossmember 14 of the base frame 100 to maintain a substantially linear direction of movement of the cushion frame 300. The recliner mechanisms 400 further include a plurality of slots 22 on the guide plates 404 to guide roller bearings 500C mounted on the backrest lock arms 414. As the cushion frame 300 moves in the extension direction (E), hook plates 302 catch roller bearings 500C located near a distal end of the backrest lock arms 414 so that the roller bearings 500C are guided through a slot 22 of the hook plates 302. As the roller bearings 500C of the backrest lock arms 414 near an end of the slots 22 of the hook plates 302, the backrest lock arms 414 pivot relative to the backrest arms 410 about backrest lock arm pivots 418, rotating via the roller bearings 500C located within the slots 22 of the guide plates 404. When the roller bearings 500C of the backrest lock arms 414 reach the end of the slots 22 of the hook plates 302 and the guide plates 404, the backrest arms 410 are free to move in the extension direction (E), and the backrest lock arms 414 are extended in the extension direction (E), thereby pivoting the backrest arms 410 relative to the recliner arms 406 about backrest arm pivots 416. As the backrest arms 410 continue to move in the extension direction (E), the backrest arms 410 recline the backrest frame 200 in a reclining direction (R) by moving the backrest frame 200 substantially in the extension direction (E) at each of the opposing backrest engaging features 402 spaced apart from the backrest arms 410 by a spacer 24. Additionally, as the backrest arms 410 reach a fully extended position after pivoting about the backrest arm pivots 416, the recliner arms 406 begin to pivot about primary pivots 408 to allow for the backrest frame 200 to continue reclining, to allow for the cushion frame 200 to continue extending, or both. It should be noted that the spindle 104 may reverse a rotational direction to move the backrest frame 200, the cushion frame 300, or both to an original starting position (e.g., in an upright position). The guide plates 404 are mounted to opposing mounting plates 106 protruding from the siderails 12 of the base frame 100 so that the guide plates 404 and the base frame 100 remain stationary during movement of the recliner 10 and are supported by stationary legs 16A of the base frame 100.

Figure 5:
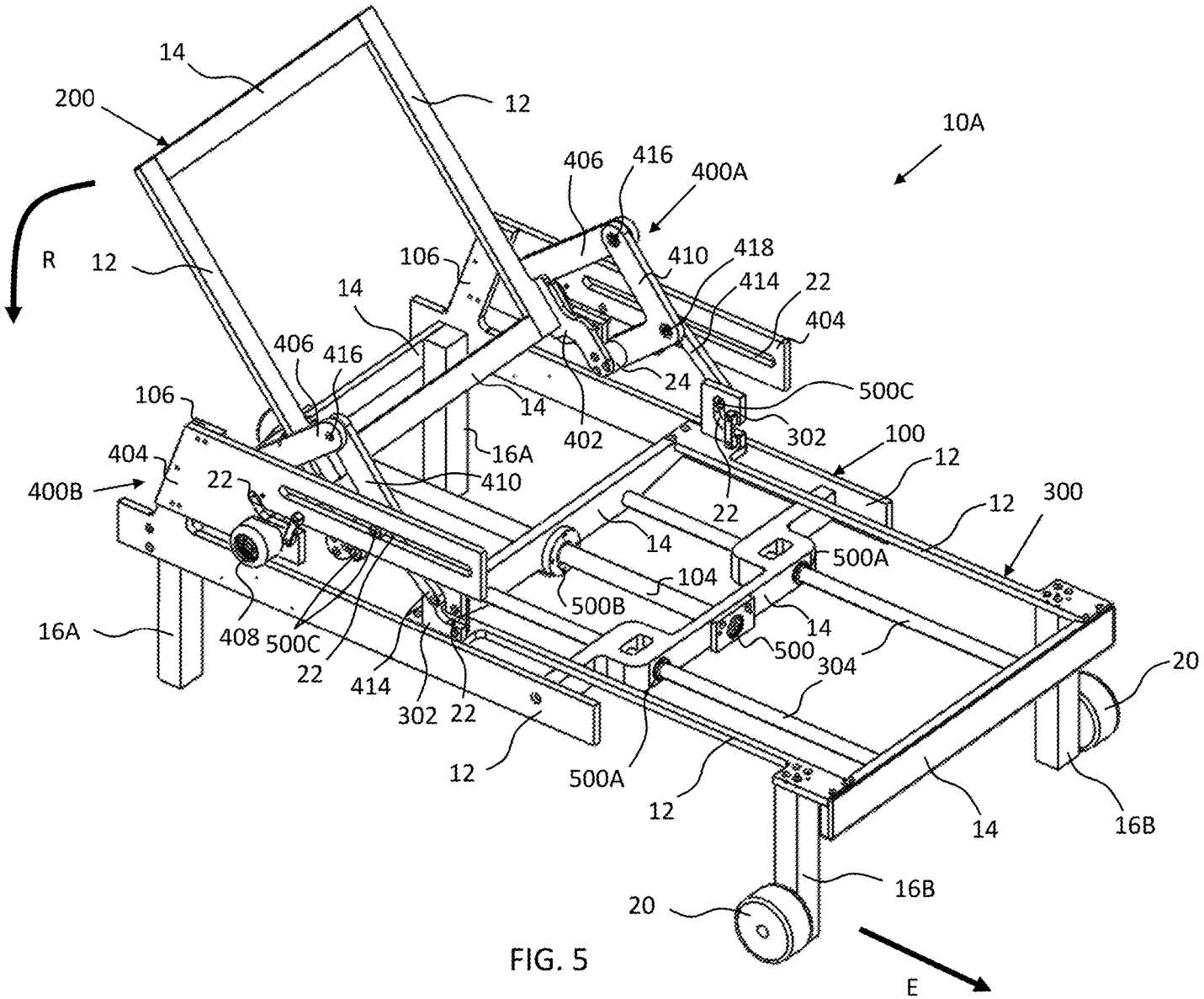
FIG. 5 illustrates a perspective view of a recliner frame in a semi-reclined position.

FIG. 5 illustrates a perspective view of a recliner frame 10A in a semi-reclined positioned. The recliner frame 10A includes a backrest frame 200 pivotally engaged to a cushion frame 300. The backrest frame 200 and the cushion frame 300 each include opposing side rails 12 connected via a pair of crossmembers 14. The side rails 12 of the backrest frame 200 are each connected to a backrest engaging feature 402 of a recliner mechanism 400. As shown, a left-hand recliner mechanism 400A and a right-hand recliner mechanism 400B each include a recliner arm 406, a backrest arm 410, and a backrest lock arm 414 movably connected via roller bearings 500C to a guide plate 404 of the recliner mechanism 400. The recliner frame 10A further includes a base frame 100 having opposing side rails 12 connected via a pair of crossmembers 14. An electromechanical unit drives a spindle 104 mounted between the electromechanical unit and a bearing 500 of the base frame 100 to move a recirculating ball bearing 500B of the cushion frame 300 in an extension direction (E), thereby moving the cushion frame 300 in the extension direction (E) via a plurality of wheels 20 secured to moveable legs 16B of the cushion frame 300 (see FIGS. 8 and 9). The cushion frame 300 further includes a pair of shafts 304 extending through linear ball bearings 500A located on the crossmember 14 of the base frame 100 to maintain a substantially linear direction of movement of the cushion frame 300. The recliner mechanisms 400 further include a plurality of slots 22 on the guide plates 404 to guide roller bearings 500C mounted on the backrest lock arms 414. As the cushion frame 300 moves in the extension direction (E), hook plates 302 catch roller bearings 500C located near a distal end of the backrest lock arms 414 so that the roller bearings 500C are guided through a slot 22 of the hook plates 302. As the roller bearings 500C of the backrest lock arms 414 near an end of the slots 22 of the hook plates 302 and the roller bearings 500C of backrest lock arms 414, the backrest lock arms 414 pivot relative to the backrest arms 410 about backrest lock arm pivots 418. When the roller bearings 500C of the backrest lock arms 414 are fully engaged in the slots 22 of the hook plates 302, the backrest lock arms 414 are extended in the extension direction (E), thereby pivoting the backrest arms 410 relative to the recliner arms 406 about backrest arm pivots 416. As the backrest arms 410 continue to move in the extension direction (E), the backrest arms 410 recline the backrest frame 200 in a reclining direction (R) by moving the backrest frame 200 substantially in the extension direction (E) at each of the opposing backrest engaging features 402 spaced apart from the backrest arms 410 by a spacer 24. Additionally, as the backrest arms 410 pivot about the backrest arm pivots 416, the recliner arms 406 pivot about primary pivots 408 to allow for the backrest frame 200 to continue reclining, to allow for the cushion frame 200 to continue extending, or both. It should be noted that the spindle 104 may reverse a rotational direction to move the backrest frame 200, the cushion frame 300, or both to an original starting position (e.g., in an upright position). The guide plates 404 are mounted to opposing mounting plates 106 protruding from the siderails 12 of the base frame 100 so that the guide plates 404 and the base frame 100 remain stationary during movement of the recliner 10 and are supported by stationary legs 16A of the base frame 100.

Figure 6:
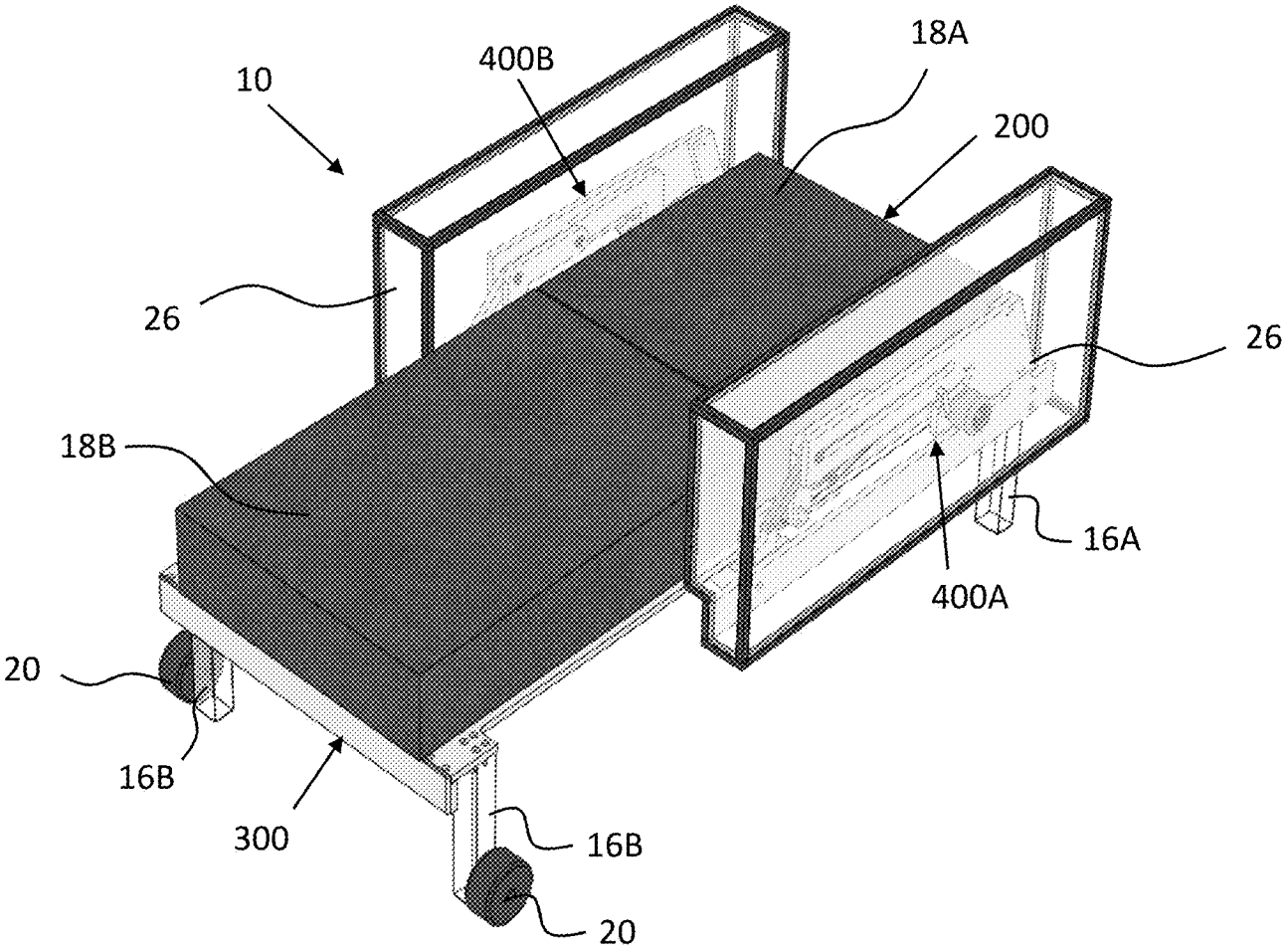
FIG. 6 illustrates a perspective view of a recliner in a fully-reclined position.

FIG. 6 illustrates a perspective view of a recliner 10 in a fully-reclined position. The recliner 10 includes a backrest frame 200 pivotally engaged to a cushion frame 300. As the backrest frame 200 reclines (i.e., pivots) and reaches the fully-reclined position, a backrest cushion 18A becomes substantially coplanar with a seat cushion 18B of the cushion frame 300 (see FIG. 5). Additionally, as the backrest frame 200 reclines, the cushion frame 300 extends forward via a plurality of wheels 20 secured to moveable legs 16B of the cushion frame 300 (see FIG. 5). The backrest frame 200 and the cushion frame 300 are moved relative to each other via a left-hand recliner mechanism 400A and a right-hand recliner mechanism 400B housed in opposing armrests 26 of the recliner 10. As the cushion frame 300 extends, retracts, or both a plurality of stationary legs 16A may maintain a position of the armrests 26.

Figure 7:
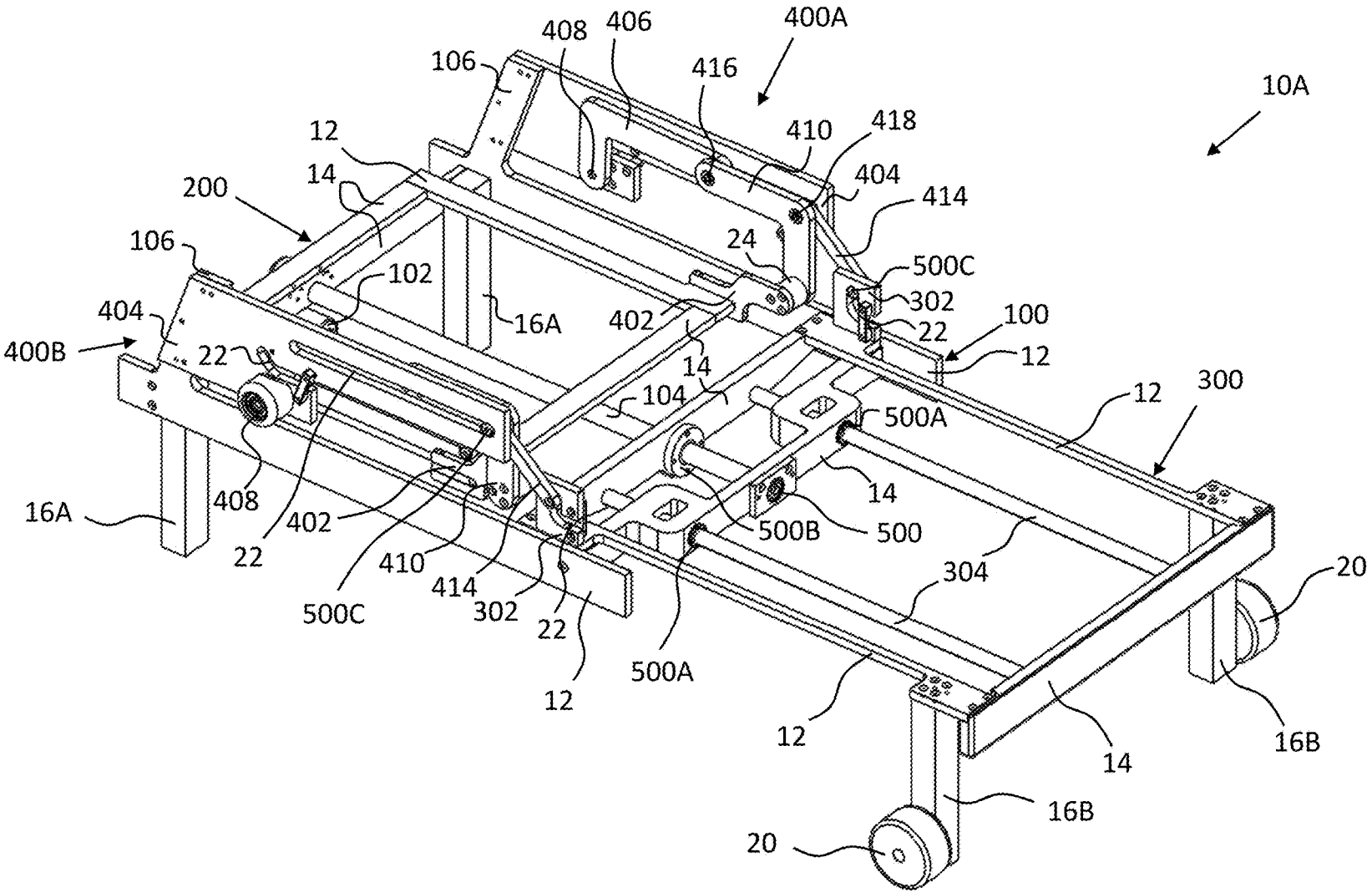
FIG. 7 illustrates a perspective view of a recliner frame in a fully-reclined position.

FIG. 7 illustrates a perspective view of a recliner frame 10A in a fully-reclined position. The recliner frame 10A includes a backrest frame 200 pivotally engaged to a cushion frame 300. The backrest frame 200 and the cushion frame 300 each include opposing side rails 12 connected via a pair of crossmembers 14. The side rails 12 of the backrest frame 200 are each connected to a backrest engaging feature 402 of a recliner mechanism 400. As shown, a left-hand recliner mechanism 400A and a right-hand recliner mechanism 400B each include a recliner arm 406, a backrest arm 410, and a backrest lock arm 414 movably connected via roller bearings 500C to a guide plate 404 of the recliner mechanism 400. The recliner frame 10A further includes a base frame 100 having opposing side rails 12 connected via a pair of crossmembers 14. An electromechanical unit 102 drives a spindle 104 mounted between the electromechanical unit 102 and a bearing 500 of the base frame 100 to move a recirculating ball bearing 500B of the cushion frame 300 in an extension direction, thereby moving the cushion frame 300 in the extension direction via a plurality of wheels 20 secured to moveable legs 16B of the cushion frame 300 (see FIGS. 2, 4, 5, 8, and 9). The cushion frame 300 further includes a pair of shafts 304 extending through linear ball bearings 500A located on the crossmember 14 of the base frame 100 to maintain a substantially linear direction of movement of the cushion frame 300. As the cushion frame 300 moves in the extension direction, hook plates 302 catch roller bearings 500C located near a distal end of the backrest lock arms 414 so that the roller bearings 500C are guided through a slot 22 of the hook plates 302. The recliner mechanisms 400 further include a plurality of slots 22 on the guide plates 404 to guide roller bearings 500C mounted on the backrest lock arms 414. The roller bearings 500C of the backrest lock arms 414 are located at the ends of the slots 22 of the hook plates 302 and the guide plates 404. It should be noted that the spindle 104 may reverse a rotational direction to move the backrest frame 200, the cushion frame 300, or both to an original starting position (e.g., in an upright position). The guide plates 404 are mounted to opposing mounting plates 106 protruding from the siderails 12 of the base frame 100 so that the guide plates 404 and the base frame 100 remain stationary during movement of the recliner 10 and are supported by stationary legs 16A of the base frame 100.

Figure 8:
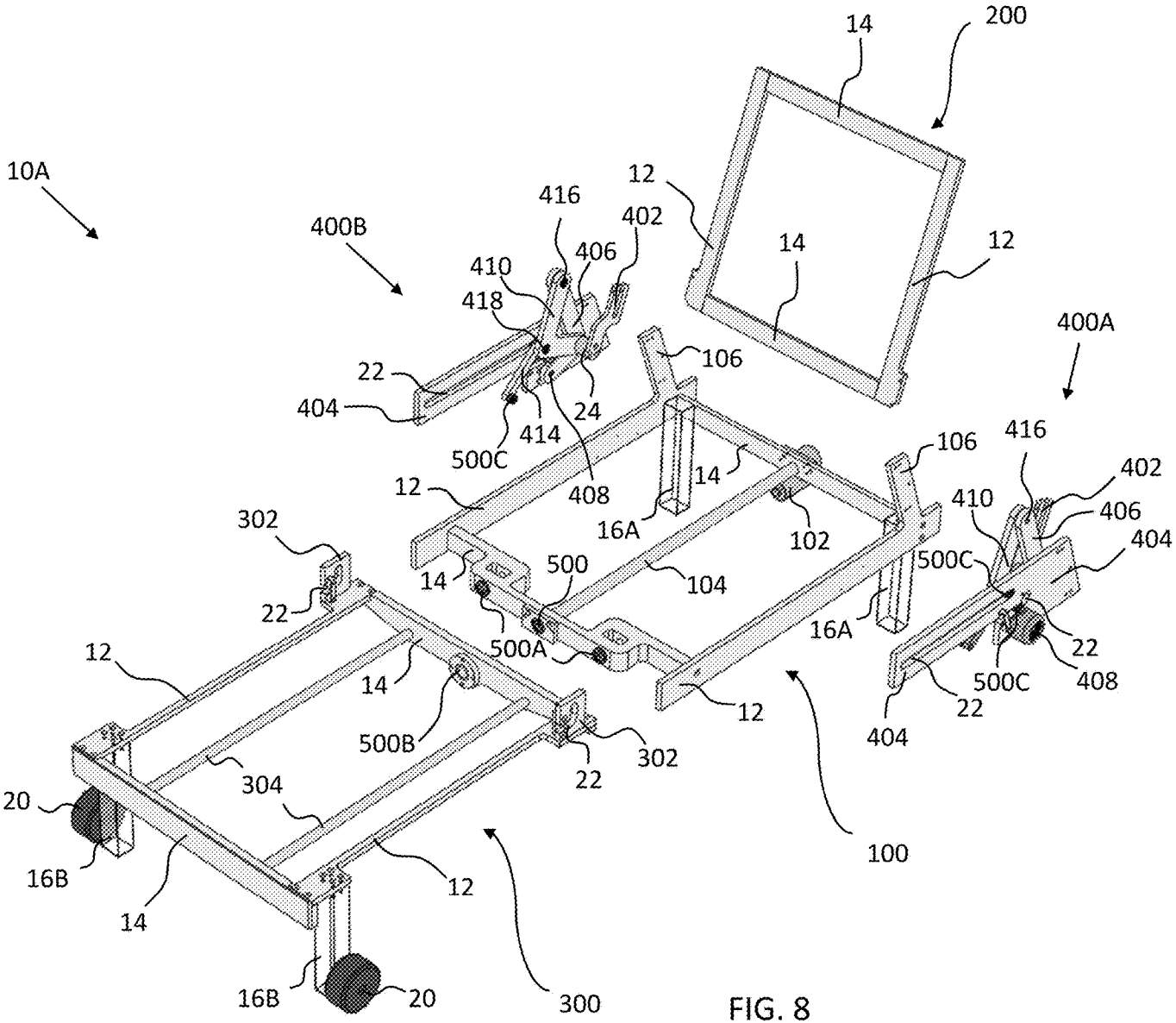
FIG. 8 illustrates an exploded view of a recliner frame.

FIG. 8 illustrates an exploded view of a recliner frame 10A. The recliner frame 10A includes a backrest frame 200 pivotally engaged to a cushion frame 300. The backrest frame 200 and the cushion frame 300 each include opposing side rails 12 connected via a pair of crossmembers 14. The side rails 12 of the backrest frame 200 are each connected to a backrest engaging feature 402 of a recliner mechanism 400. As shown, a left-hand recliner mechanism 400A and a right-hand recliner mechanism 400B each include a recliner arm 406, a backrest arm 410, and a backrest lock arm 414 movably connected to a guide plate 404 of the recliner mechanism 400. The recliner frame 10A further includes a base frame 100 having opposing side rails 12 connected via a pair of crossmembers 14. An electromechanical unit 102 drives a spindle 104 mounted between the electromechanical unit 102 and a bearing 500 of the base frame 100 to move a recirculating ball bearing 500B of the cushion frame 300 in an extension direction, thereby moving the cushion frame 300 in the extension direction via a plurality of wheels 20 secured to moveable legs 16B of the cushion frame 300 (see FIGS. 3-5, 8, and 9). The cushion frame 300 further includes a pair of shafts 304 extending through linear ball bearings 500A located on the crossmember 14 of the base frame 100 to maintain a substantially linear direction of movement of the cushion frame 300. The recliner mechanisms 400 further include a plurality of slots 22 on the guide plates 404 to guide roller bearings 500C mounted on the backrest lock arms 414. As the cushion frame 300 moves in an extension direction, hook plates 302 catch roller bearings 500C located near a distal end of the backrest lock arms 414 so that the roller bearings 500C are guided through a slot 22 of the hook plates 302. As the roller bearings 500C of the backrest lock arms 414 near an end of the slots 22 of the hook plates 302, the backrest lock arms 410 pivot relative to the backrest arms 410 about backrest lock arm pivots 418, rotating via the roller bearings 500C located within the slots 22 of the guide plates 404. When the roller bearings 500C of the backrest lock arms 414 reach the end of the slots 22 of the hook plates 302 and the guide plates 404, the backrest arms 410 are free to move in the extension direction, and the backrest lock arms 414 are extended in the extension direction, thereby pivoting the backrest arms 410 relative to the recliner arms 406 about backrest arm pivots 416. As the backrest arms 410 continue to move in the extension direction, the backrest arms 410 recline the backrest frame 200 in a reclining direction by moving the backrest frame 200 substantially in the extension direction at each of the opposing backrest engaging features 402 spaced apart from the backrest arms 410 by a spacer 24. Additionally, as the backrest arms 410 reach a fully extended position after pivoting about the backrest arm pivots 416, the recliner arms 406 begin to pivot about primary pivots 408 to allow for the backrest frame 200 to continue reclining, to allow for the cushion frame 200 to continue extending, or both. It should be noted that the spindle 104 may reverse a rotational direction to move the backrest frame 200, the cushion frame 300, or both to an original starting position (e.g., in an upright position). The guide plates 404 are mounted to opposing mounting plates 106 protruding from the siderails 12 of the base frame 100 so that the guide plates 404 and the base frame 100 remain stationary during movement of the recliner 10 and are supported by stationary legs 16A of the base frame 100.

Figure 9:
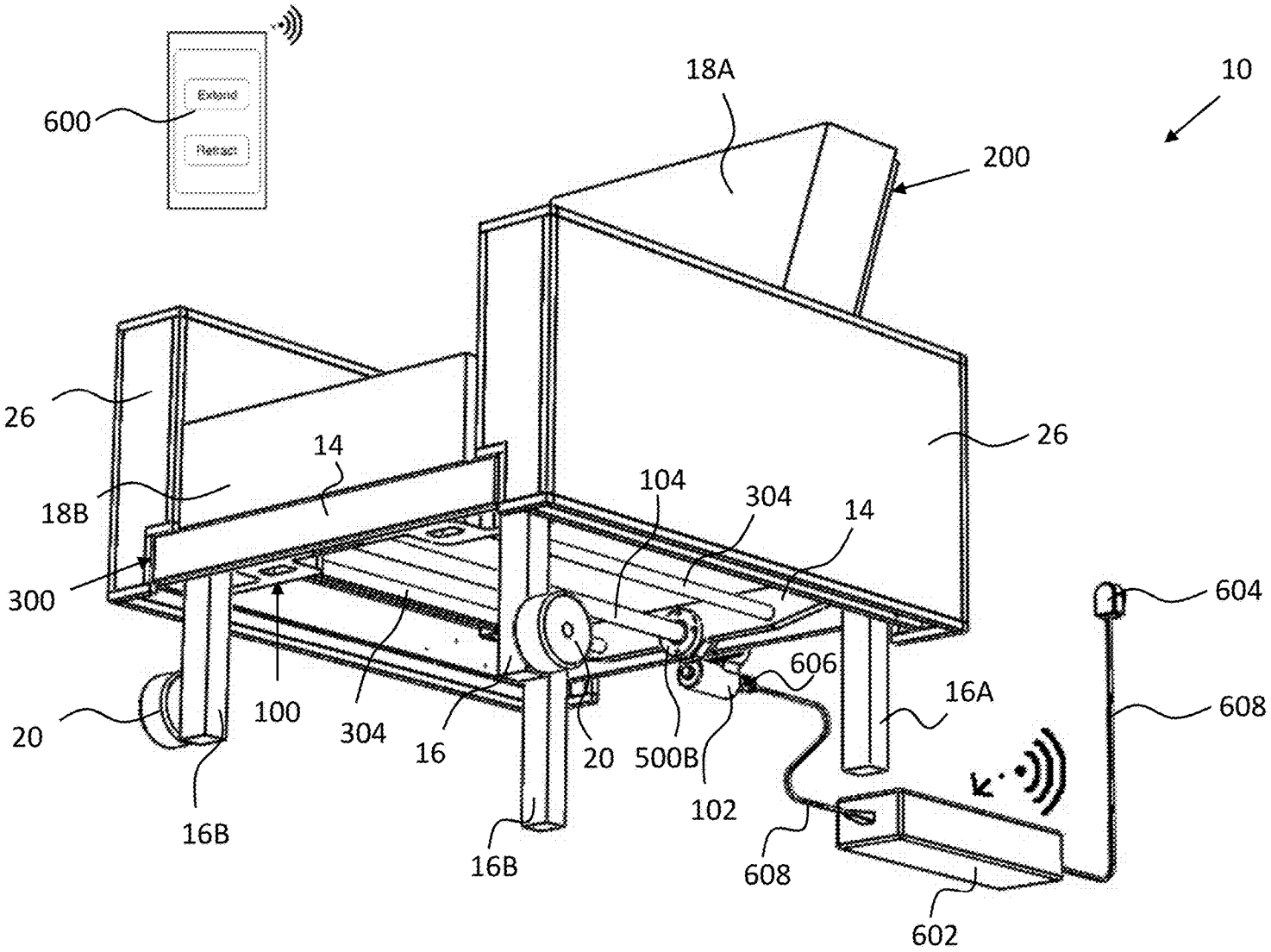
FIG. 9 illustrates a bottom perspective view of a recliner in an upright position connected to a wireless electronic device via a controller.

FIG. 9 illustrates a bottom perspective view of a recliner 10 in an upright position. The recliner 10 includes a backrest frame 200 selectably and pivotally engaged to a cushion frame 300. As the backrest frame 200 reclines (i.e., pivots), a backrest cushion 18A reclines until it becomes substantially coplanar with a seat cushion 18B of the cushion frame 300 (see FIGS. 2, 4, and 5). The backrest frame 200 and the cushion frame 300 are moved relative to each other via recliner mechanisms (not shown) housed in opposing armrests 26 of the recliner 10. It should be noted that the backrest frame 200 may maintain any angle relative to the cushion frame 300 due to opposing backrest lock arms of the recliner mechanisms engaging hook plates of the cushion frame 300 (see FIGS. 3-5). The backrest frame 200 is also support by a spindle 104 extending between crossmembers 14 of a base frame 100. An electromechanical unit 102 drives the spindle 104 mounted to the base frame 100 to move a recirculating ball bearing 500B of the cushion frame 300 in an extension direction, thereby moving the cushion frame 300 in the extension direction via a plurality of wheels 20 secured to legs 16 of the cushion frame 300 (see FIGS. 3-5). The cushion frame 300 further includes a pair of shafts 304 extending through linear ball bearings (not shown) located on the crossmember 14 of the base frame 100 to maintain a substantially linear direction of movement of the cushion frame 300. A controller 602 controls movement of the electromechanical unit 102 via a controller output 606 received by the electromechanical unit 102 and connected to the controller 602 via a wire 608. The controller 602 receives power from a controller input 604 connected to the controller 602 via an additional wire 608. The controller 602 may wirelessly communicate with an electronic device 600 (e.g., a smartphone) so that a user may operate the recliner 10 (i.e., direct the recliner 10 to recline, retract, or both) using the electronic device 600. It should be noted that wireless communication may be performed via any short distance wireless communication protocol (e.g., Bluetooth).

ELEMENT LIST

10 Recliner
10A Recliner Frame
12 Side Rail
14 Crossmember
16 Leg
16A Stationary Leg
16B Moveable Leg
18 Cushion
18A Backrest Cushion
18B Seat Cushion
20 Wheel
22 Guide Slot
24 Spacer
26 Armrest
100 Base Frame
102 Electromechanical Unit
104 Spindle
106 Mounting Plate
200 Backrest Frame
300 Cushion Frame
302 Hook Plate
304 Shaft
400 Recliner Mechanism
400A LH Recliner Mechanism
400B RH Recliner Mechanism
402 Backrest Engaging Feature
404 Guide Plate
406 Recliner Arm
408 Primary Pivot
410 Backrest Arm
414 Backrest Lock Arm
416 Backrest Arm Pivot
418 Backrest Lock Arm Pivot
500 Bearing
500A Linear Ball Bearing
500B Recirculating Ball Bearing
500C Roller Bearing
600 Electronic Device
602 Controller
604 Controller Input
606 Controller Output
608 Wire
R Reclining Direction (of Backrest Frame)

The explanations and illustrations presented herein are intended to acquaint others skilled in the art with the invention, its principles, and its practical application. The above description is intended to be illustrative and not restrictive. Those skilled in the art may adapt and apply the invention in its numerous forms, as may be best suited to the requirements of a particular use.

Accordingly, the specific embodiments of the present invention as set forth are not intended as being exhaustive or limiting of the teachings. The scope of the teachings should, therefore, be determined not with reference to this description, but should instead be determined with reference to the appended claims, along with the full scope of equivalents to which such claims are entitled. The omission in the following claims of any aspect of subject matter that is disclosed herein is not a disclaimer of such subject matter, nor should it be regarded that the inventors did not consider such subject matter to be part of the disclosed inventive subject matter.

Plural elements or steps can be provided by a single integrated element or step. Alternatively, a single element or step might be divided into separate plural elements or steps.

The disclosure of "a" or "one" to describe an element or step is not intended to foreclose additional elements or steps.

While the terms first, second, third, etc., may be used herein to describe various elements, components, regions, layers and/or sections, these elements, components, regions, layers and/or sections should not be limited by these terms. These terms may be used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Unless otherwise stated, a teaching with the term "about" or "approximately" in combination with a numerical amount encompasses a teaching of the recited amount, as well as approximations of that recited amount. By way of example, a teaching of "about 100" encompasses a teaching of 100+/−15.

The disclosures of all articles and references, including patent applications and publications, are incorporated by reference for all purposes. Other combinations are also possible as will be gleaned from the following claims, which are also hereby incorporated by reference into this written description.

What is claimed is:

1. A recliner, comprising:

a. a stationary base frame;

b. a cushion frame slidably engaged to the base frame for movement of the cushion frame along a path; and c. a backrest frame pivotally engaged to the cushion frame via a pair of opposing recliner mechanisms mounted to the base frame, each recliner mechanism including a backrest lock arm with a first end having a roller bearing protruding into the path, wherein the cushion frame includes a pair of hook plates that protrude into the path and receive the roller bearings of the recliner mechanisms in a slot of each hook plate during movement of the cushion frame, and wherein, the cushion frame moves independently of the backrest frame in an extension direction until the hook plates of the cushion frame engage the roller bearings of the pair of opposing recliner mechanisms causing the backrest frame to pivot in a reclining direction simultaneously with further movement of the cushion frame in the extension direction.

2. The recliner according to claim 1, wherein, prior to engaging the pair of opposing recliner mechanisms, the cushion frame extends and retracts independently of the backrest frame pivoting.

3. The recliner according to claim 1, wherein the backrest frame pivots between an upright position to a fully-reclined position substantially coplanar or parallel with the cushion frame.

4. The recliner according to claim 1, wherein an electromechanical unit mounted to the base frame drives a spindle connecting the cushion frame and the base frame to each other to move the cushion frame in the extension direction.

5. The recliner according to claim 1, wherein cushion frame is guided along a pair of shafts extending between crossmembers of the cushion frame and that extend through a pair of respective linear ball bearings of the base frame.

6. The recliner according to claim 1, wherein the base frame, the cushion frame, and the backrest frame each comprise a pair of side rails connected by a pair of crossmembers extending between the side rails, and wherein each recliner mechanism includes a recliner arm, a backrest arm, the backrest lock arm, or a combination thereof pivotally engaged to one another and pivotally mounted to a guide plate of the recliner mechanism.

7. The recliner according to claim 1, wherein backrest engaging features of the recliner mechanisms attach to side rails of the backrest frame, and the cushion frame and the backrest frame each include a cushion disposed on a surface of the cushion frame and the backrest frame respectively.

8. The recliner according to claim 1, wherein the recliner is wirelessly controlled by an electronic device in communication with a controller of the recliner that powers the recliner.

9. The recliner according to claim 1, wherein the base frame is free of a cushion; the base frame remains stationary during movement of the cushion frame, the backrest frame, or both; or both.

10. The recliner according to claim 1, wherein the cushion frame is moved with a plurality of wheels movably secured to a plurality of respective legs protruding from the cushion frame.

11. The recliner according to claim 1, wherein the pair of opposing recliner mechanisms are housed in a pair of opposing armrests of the recliner.

12. The recliner according to claim 4, wherein the spindle extends between the electromechanical unit mounted to a first crossmember and a bearing of a second crossmember, and when the spindle is driven by the electromechanical unit, a recirculating ball bearing of the cushion frame is driven in the extension direction.

13. The recliner according to claim 4, wherein the spindle is configured to rotate in a clockwise direction, a counterclockwise direction, or both, relative to the extension direction.

14. The recliner according to claim 4, wherein the spindle supports a load of the backrest frame, the cushion frame, or both so that the backrest frame may be positioned in any position between the upright position and the fully-reclined position.

* * * * *